US006435279B1

(12) United States Patent
Howe et al.

(10) Patent No.: US 6,435,279 B1
(45) Date of Patent: Aug. 20, 2002

(54) METHOD AND APPARATUS FOR SAMPLING FLUIDS FROM A WELLBORE

(75) Inventors: David Charles Howe, Aberdeen; Kevin Fraser Robb, Stonehaven, both of (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/546,256

(22) Filed: Apr. 10, 2000

(51) Int. Cl.[7] ..... E21B 49/08

(52) U.S. Cl. ..... 166/336; 166/351

(58) Field of Search ..... 166/336, 352, 166/359, 357, 356, 363, 366, 351

(56) References Cited

U.S. PATENT DOCUMENTS

| | | | | | |
|---|---|---|---|---|---|
| 3,294,185 | A | * | 12/1966 | O'Neill et al. | 166/356 X |
| 3,520,358 | A | * | 7/1970 | Brooks et al. | 166/356 X |
| 3,602,301 | A | * | 8/1971 | James | 166/356 |
| 3,621,911 | A | * | 11/1971 | Baker | 166/356 |
| 3,643,736 | A | * | 2/1972 | Talley, Jr. | 166/336 X |
| 4,502,551 | A | * | 3/1985 | Rule et al. | 166/350 X |

* cited by examiner

*Primary Examiner*—Frank Tsay

(57) ABSTRACT

A method and apparatus for sampling fluids from an undersea wellbore comprising a self-propelled underwater vehicle and a collection and storage device; so that samples may be recovered directly from the wellbore and subsequently analyzed to determine the characteristics of the oil produced from separate wells.

27 Claims, 19 Drawing Sheets

Sampling Equipment

Sampling Equipment

Onhore Hydrotest

Nitrogen Leak Test

Bottle Fill and System Purge

System Transport Condition

Spare Sample Bottle Transport Condition

Prior to Dive

After ROV Docked at Panel
*FIG. 6a-d*

Start of Sampling Operation

Sampling Into Bottle B1

Sampling Complete, Recovered to Surface

Venting of Bottle B1 to Slop Tank

Filling Back of Bottle B1 with Water/Glycol

Venting Pipework Either Side of Bottle B2 Prior to Removal

Removal of Bottle B2

New Sample Bottle Fitted, Flushing of Pipework

Purging of Pipework with Nitrogen

Nitrogen Fill of Skid

Leak Test of Bottle Connection Points

METHOD AND APPARATUS FOR SAMPLING FLUIDS FROM A WELLBORE

BACKGROUND TO THE INVENTION

This invention relates to a method and apparatus for sampling fluids from a wellbore, and in particular to a method and apparatus used to recover a quantity of production fluids such as produced oil, gas and/or water from the wellhead of an underwater well.

Wells for hydrocarbons and other valuable fluids are normally drilled in a cluster with a number of wellbores having their surface wellheads grouped together. The wellbore may diverge away from each other the deeper they become. The wellheads in a group of wells are typically connected to a manifold or other subsea structure via conduits, and the hydrocarbons recovered from each individual well are conveyed along the conduits to the manifold where they usually co-mingle before flowing along a single main pipeline to the production platform. The quality and quantity of the fluids produced from each well may vary; for example, one wellbore may produce production fluids that are rich in crude oil and relatively free from produced water and corrosive gasses such as $H_2S$, whereas a neighbouring well drilled to a different depth in the same formation may produce more water, or may have a high content of noxious and corrosive gasses; such a well would be less economically productive and may have higher maintenance costs. Furthermore, different wells tied back to the same manifold may be owned and/or operated by different operators. It is therefore useful to know the quantity and quality of wellbore fluids that are produced from each respective wellbore before they are mixed in the manifold or main pipeline leading from the manifold to the production platform, so that the relative benefits and liabilities of the respective wells can be calculated.

Traditionally this has been done by sampling the fluids produced at each respective wellbore by providing separate sampling conduits or lines that run parallel to (and usually along the outside of) the conduits between the respective wellbores and the manifold, and from there along the main pipeline back to the production platform, where they can be analysed and graded. Separate sampling lines are of course needed for each wellbore, and this causes several problems in that the additional small bore lines often become blocked by viscous fluids and cuttings, or damaged by corrosive agents like $H_2S$, and to address this several lines are normally installed for each wellhead all the way back to the platform, so that backup lines can be brought into operation if the main sampling line for a particular wellhead fails or becomes blocked. This is very expensive and the infrastructure of the extra lines needs to be installed at the beginning of the life of a well, but is seen as the only solution to the problems of being able to sample continuously throughout the life of the well.

SUMMARY OF THE INVENTION

According to the present invention there is provided a method for sampling a fluid from a wellbore, the method comprising

- a vehicle having a drive means for moving the vehicle, a collecting device for collecting a sample of the fluid and a storage facility for the collected fluid;
- using the collecting device to recover a sample of the fluid to the vehicle's storage facility at a first location on a subsea structure;
- storing the sample in the storage facility of the vehicle; and
- carrying the sample in the vehicle's storage facility to a second location.

The present invention also provides a sampling device for collecting samples of fluid produced from a subsea wellbore, the sampling device having;

- a drive means for moving the sampling device, a collection device for collecting a sample of fluid and a storage container for holding the collected fluid.

The first location is typically a wellhead but can be other positions of a well such as a wellbore, pipeline from the wellhead, side-track manifold, or main pipeline, storage tank or gravity base structure. The first position typically has a collection port to mate with the collection apparatus. The second position can be onshore, underwater or on a platform or ship such as a remotely operated vehicle or "ROV".

Preferably the vehicle is an ROV. Preferably the storage tank and collection device are housed on a frame or skid attached to the ROV. Typically the collecting device comprises at least one sampling bottle, but two or more can be provided.

Typically the vehicle is adapted to interface with the wellhead at the first position, and can be provided with a collecting and sampling probe for insertion into e.g. an aperture on the wellhead. The probe can be connected to the storage tanks or bottles etc by means of conduits. Typically production fluids are extracted via the male/female connection between the probe and the aperture. The collecting device can be arranged to collect and discard a portion of the fluids being sampled, and typically recovers an initial sample of fluid from the collection port of the wellhead to a first sampling bottle. This is done because the fluid lying in the collection port of the wellhead may be static and may not represent a true sample of the fluid flowing through the wellhead. Therefore, the first sample of fluid from the collection port of the wellhead is drawn off to a first sampling bottle and can be kept separate from later samples. Any number of later samples e.g. 3–10 can be taken from the fluid flowing through the wellhead, depending on the number of sampling bottles or partitions in the collection tank that are available. Typically a waste tank is provided at the second position into which the initial samples of static fluid can be discarded.

Typically the vehicle has an array of valves which can be activated independently of each other. Typically different configuration of the valves will direct liquid into each sampling bottle as required. Typically the sampling bottles each contain a piston. Normally a pressure gauge is connected to each sampling bottle. Normally a piston indicator is provided so the position of the piston can be determined from a remote position outside the bottle. Typically the piston indicator moves with the piston, but it may be an electronic indicator that is monitored elsewhere on the ROV or remote from it. Typically the piston indicator is a rod which extends from the piston outside the bottle. Typically the sampling bottles are connected to the male connector via a hose of e.g. ¼" diameter. The sampling bottles, valves and hose are typically designed to operate in pressure of up to 230 barg and at temperatures of −50 to 130° C.

During transportation of the ROV prior to use, the sampling apparatus is typically filled with a liquid. Preferably the liquid is bio-degradable. Typically the liquid is a mixture of water and glycol.

Typically the liquid is contained in the sampling bottles when the vehicle dives. Typically the liquid is expelled from a second end of the sampling apparatus as fluid is recovered from the wellhead. Preferably a control means such as a throttle is provided on the second end of the sampling apparatus to control the rate of expulsion of the liquid. This typically controls the rate of introduction of the fluid from the wellhead into the first end of the sampling apparatus, typically via the piston.

When production fluids have been extracted from the first wellhead the vehicle typically disengages the probe from the collection port on the wellhead and moves (in ROV terminology it "flies") to the second position. The second position can typically be an offshore platform, a ship or an inshore facility. The vehicle typically docks at the second position where the sample(s) collected may be removed by e.g. removing the sampling bottles and replacing them with empty bottles. Typically only the second and subsequent sampling bottles are replaced. Typically the fluid(s) contained in the second or further sampling bottle is analysed for fluid chemistry.

In several important embodiments of the invention the collection device has several separate containers such as bottles for collecting samples and the vehicle flies between adjacent wellheads to collect samples from each of them before returning to the ship or platform etc for analysis of the samples. In this embodiment the vehicle can collect different samples from adjacent wellheads on a single trip.

While the ROV can be typically tied back to a ship or platform by a conventional umbilical the vehicle need not be a conventional ROV.

Typically the fluids contained in the first sampling bottle will be released into the waste tank. Normally this operation is performed at the second position. Typically a particular combination of open and closed valves can be used to direct fluids from any sampling bottle to the waste tank.

The pipework is typically vented before the sampling bottles are removed. This typically allows the pressure in the pipework to be equilibrate with ambient pressure and so ease the removal of the sampling bottles from the vehicle. Typically a particular configuration of the valves can be used to vent the pipework. After the pipework has been vented the sampling bottle(s) may be removed.

A new bottle is typically attached to the sampling apparatus. Typically the sampling apparatus is flushed with de-mineralised water to prevent cross-contamination between samples. Typically the sampling apparatus is purged with nitrogen prior to a subsequent sampling run in order to remove air from the pipework. Typically the sampling apparatus will be tested for leaks whenever a sampling bottle has been replaced.

Typically the vehicle (or at least the collection device) will undergo a hydrotest before a second operation. In the hydrotest the sampling bottles are filled with de-mineralised water and pressurised up to 230 barg. If no leaks or change in pressure are observed after a period in the order of 30 minutes the vehicle is typically subjected to a gas test. During the gas test, the vehicle (or at least the collection device) is typically submerged in a water bath and is flushed with Nitrogen gas through the probe to subject the sampling apparatus to a pressure of up to 125 barg. Any leaks would clearly be observed in the form of bubbles escaping from the vehicle or collection device.

BRIEF DESCRIPTION OF THE DRAWINGS

An embodiment of the invention will now be described by way of example only with reference to the accompanying drawings wherein.

DETAILED DESCRIPTION OF THE DRAWINGS

Figure 1:
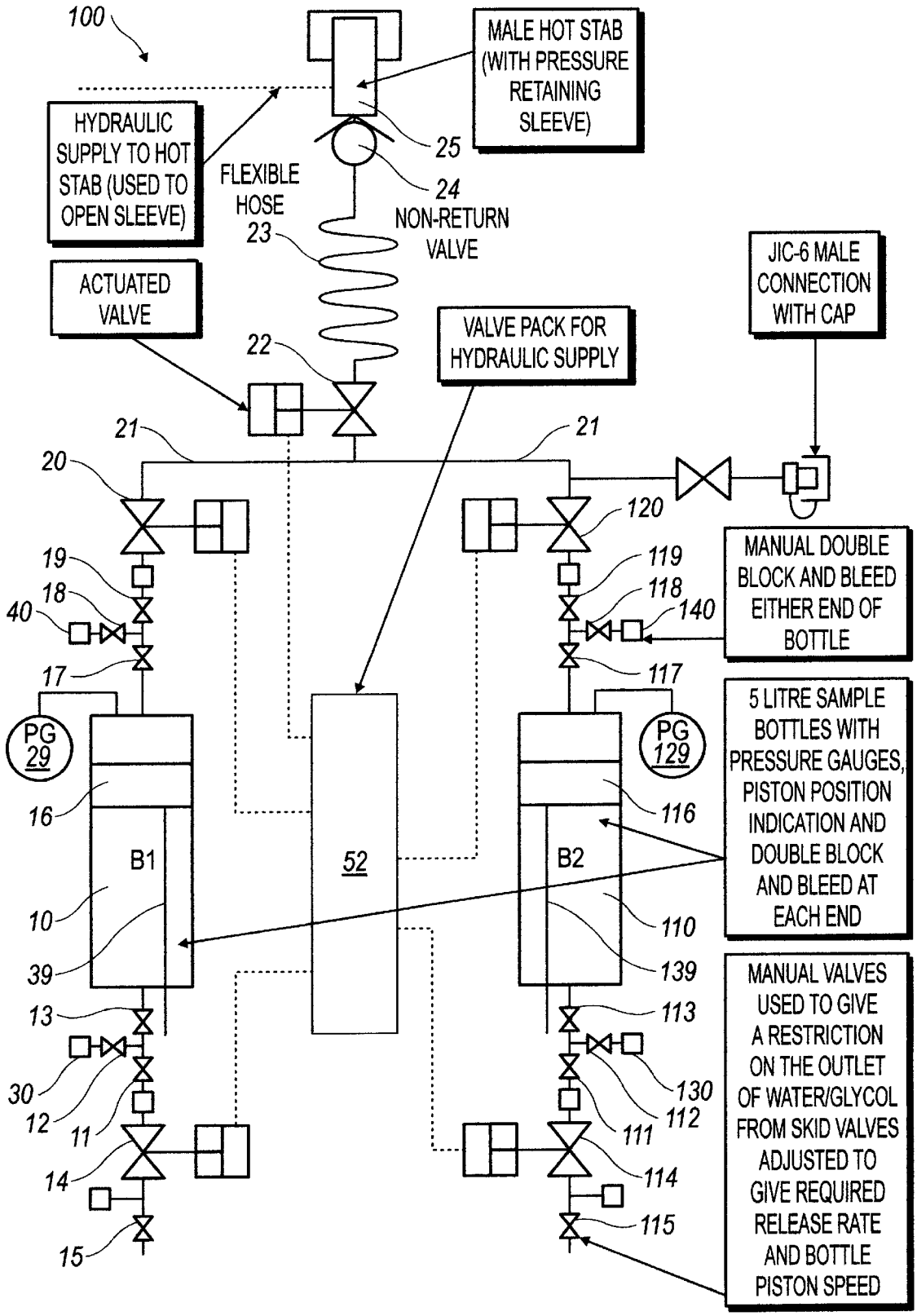
FIG. 1 is a drawing of the sampling equipment.

Referring now to the drawings, a collection device has a first sampling bottle 10 connected between valves 11–15 at the back end 27 of the bottle 10, and valves 17–20 at the front end 28. A second sampling bottle 110 is provided adjacent to the first 10 and is connected between valves 111–115 at the back 127 of the bottle 110 and valves 117–120 at a front opposite end 128. The valves 20, 120 are connected together by line 21. Pressure gauges 29, 129 (not shown in all Figs) are provided for each sampling bottle 10, 110. A piston 16, 116 is provided inside each sampling bottle 10, 110. Rods 39, 139 shown in FIG. 1 (but omitted from the other figures for clarity) are attached to and move with the pistons 16, 116. Each rod 39, 139 extends from a respective piston 16, 116 through the back of a respective bottle 28, 128 and so provides a means to determine the position of the pistons inside the sampling bottles. The rods can be sealed against the ends of the bottles by o-rings etc (not shown).

In the drawings, a black-shaded valve indicates the valve is closed, while an unshaded valve indicates the valve is open. A valve shaded in grey indicates the valve is partially open. Valves 15, 115 remain partially open throughout all operations and so will not be referred to again.

The collection device is disposed in a frame or "skid" 60 that is connectable to the base of an underwater vehicle or ROV 200. The ROV 200, as is conventional in the art, typically has a motor (not shown) to move the skid between first and second positions, and an umbilical line connecting the ROV 200 to the operating station. Typically the umbilical line comprises a cable to power the hydraulic and electrical systems on the ROV 200 and any other cables such as those connected to onboard cameras.

Figure 19A:
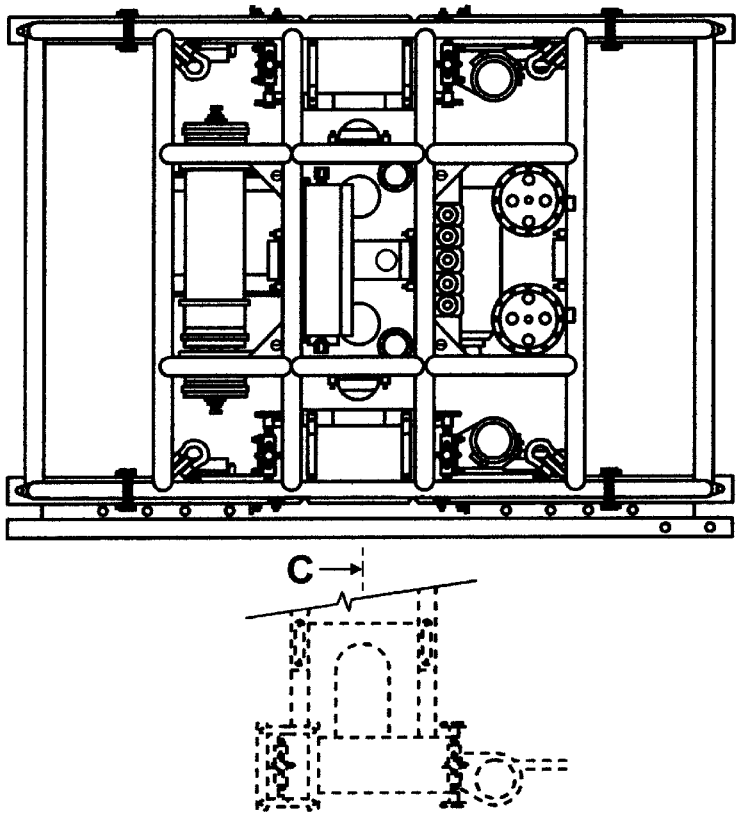
FIGS. 19*a–c* are selection of views of the FIG. 18 skid attached to an ROV.
Figure 19B:
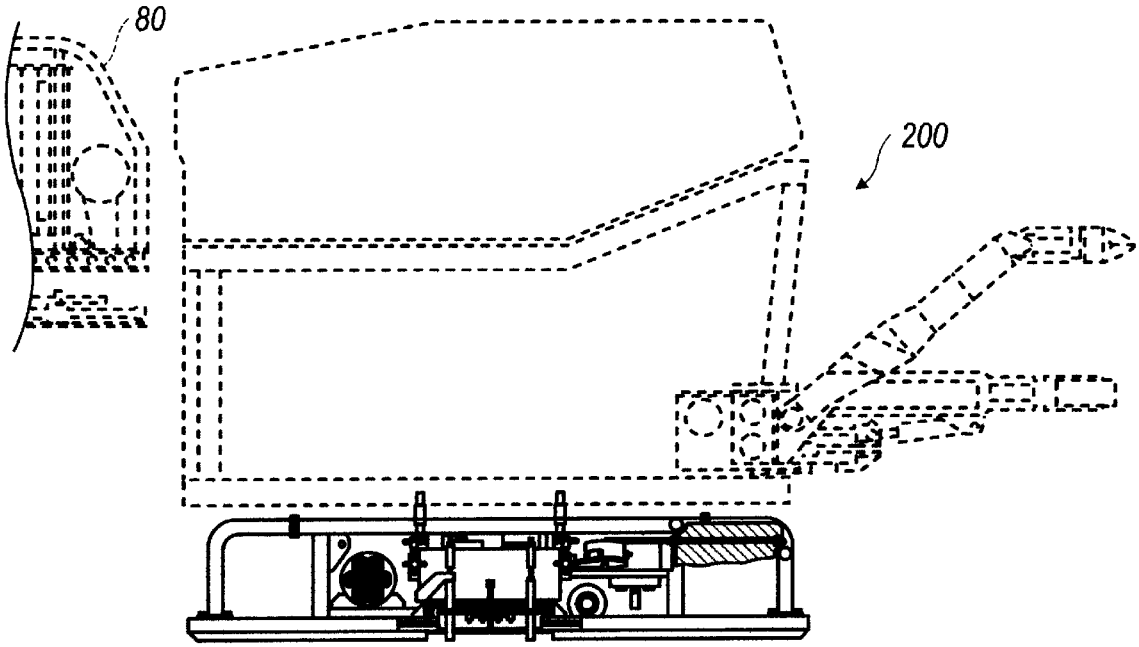
Figure 19C:
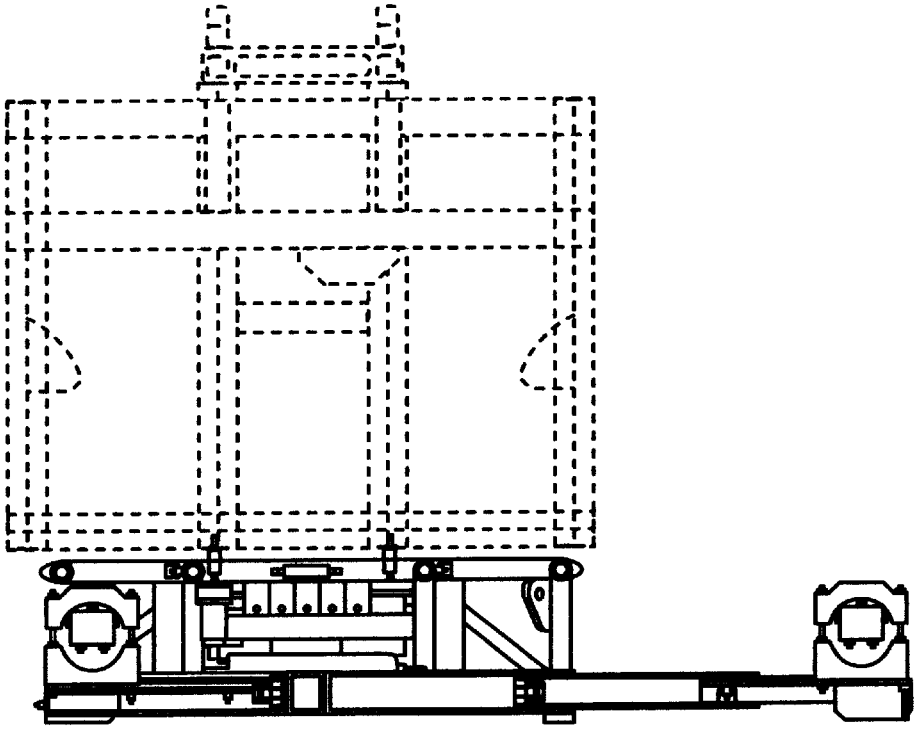
Figure 20A:
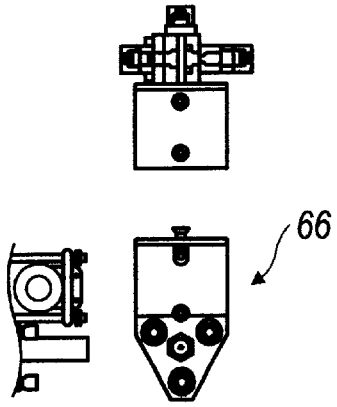
FIGS. 20*a–h* are general arrangement showing the tools attached to the ROV.
Figure 20B:
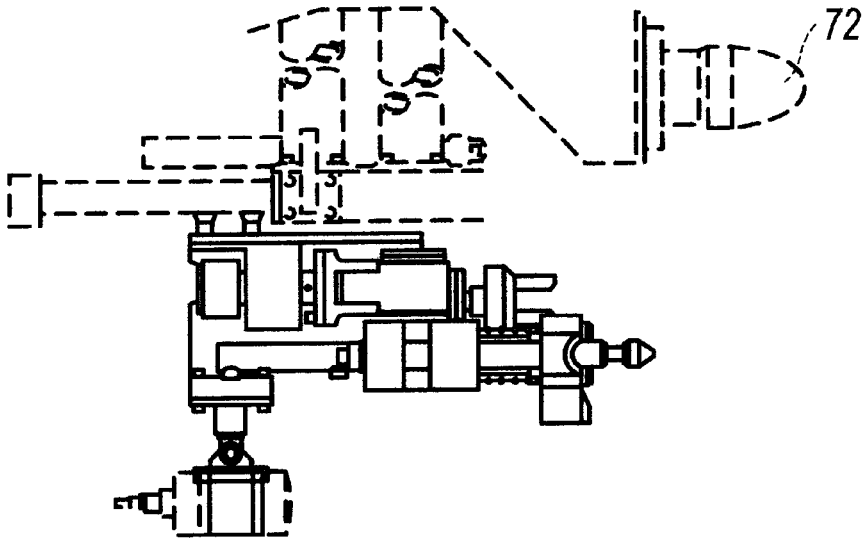
Figure 20C:
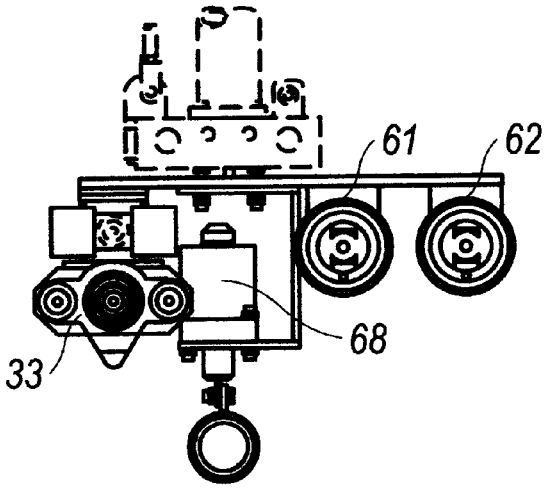
Figure 20D:
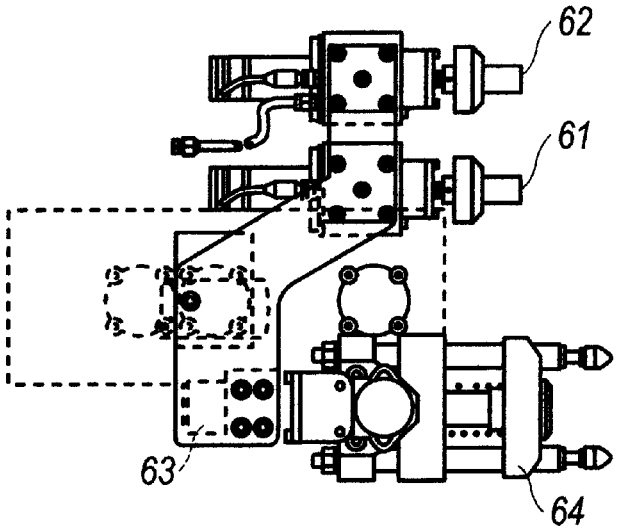
Figure 20E:
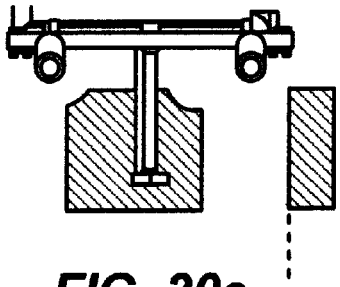
Figure 20F:
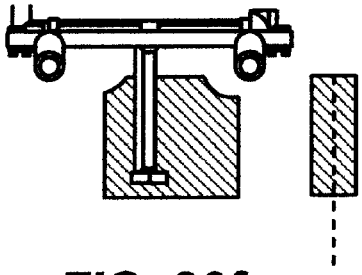
Figure 20G:
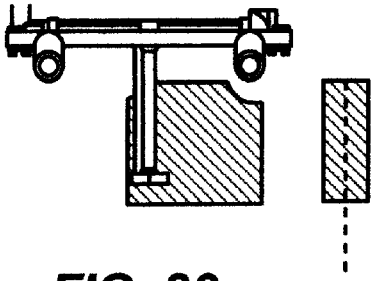
Figure 20H:
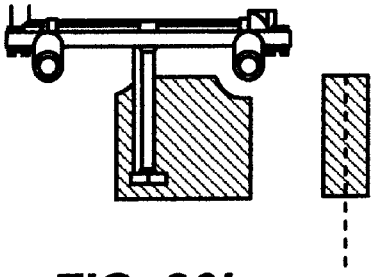

A tool deployment unit (TDU) or XYZ tool position unit 80 is attached to the ROV 200 as shown in FIG. 19*b*. The TDU 80 may comprise various tools like grabs, cameras, docking probes and sockets to facilitate docking of the ROV 200 with a manifold etc and can move in a vertical, horizontal and fore-aft direction relative to the ROV 200. The TDU chosen typically has a low torque tool mounting bracket 65 fitted to the lower carriage of the ROV 200 and two low torque tools 61, 62 fitted to the port side of the mounting bracket 65. The tools 61 and 62 are primarily for activating isolation valves 31, 32 on the wellhead but can be used for a wide variety of other operations. A grabber tool 63 is fitted to the starboard side of the mounting bracket 65 and holds a single port male hot stab tool 33 fitted with a grabber handle to connect with the grabber tool 63. The male hot stab tool 33 is typically a standard sampling probe. The male hot stab tool 33 is connected to the sampling equipment 100 by a hose 23 and two hydraulic lines. In practise it may be necessary to alter the configuration of the low torque tools 61, 62 and the grabber tool 63 so they correspond with the receptacles and valves at the particular wellhead where the ROV 200 will be docking.

The TDU has two docking probes 71, 72 which engage receptacles (not shown) at the wellhead. These stabilise the ROV 200 in position when it docks at a wellhead. Alternatively, other docking means may be used.

The sampling skid has a quick-connect fail-safe release mechanism 66 in-line with the hoses 23 to the hot stab tool 33 securely mounted in a suitable location on the ROV 200 frame. The fail safe mechanism is activated when either hydraulic or electric power is lost to the sampling skid and ensures that no hydrocarbons are lost and that the ROV 200 may be recovered. An accumulator 54 is provided, charged with hydraulic power to provide power in sequence to various parts of the skid if necessary. First, the accumulator provides power to the torque tools 61, 62 to close off the isolation valves 31, 32. Then, the fluid connection between the male stab and the female connector is broken. Each of the hoses connecting the male hot stab to the sampling skid are then broken and the male hot stab is left loosely attached to the female member. The hoses which connect the male hot-stab to the skid are self-sealing and so do not pollute the environment when disconnected. A separate accumulator on the TDU (not shown) provides power for the ROV 200 to disengage from the receptacles. The ROV 200 is then recovered for example by towing in, repaired and re-deployed.

A camera pan unit 68 is provided on the mounting bracket 65 of the TDU positioned to allow the camera to view the low torque tools 61, 62 and the hot stab tool 33. Other tooling cameras (not shown) are provided (i) mounted to the camera pan unit for vertical alignment of the low torque tools 61, 62 and hot-stab tool 33 with their interfaces and to monitor torque tool turns, (ii) mounted to the TDU for horizontal alignment of the low torque tools 61, 62 and the hot-stab tool 33 with their interfaces and to monitor torque tool turns, (iii) positioned to view the pressure gauge 29 and indicator rod 39 on the first sampling bottle 10, (iv) positioned to view the pressure gauge 129 and indicator rod 139 on the second sample bottle 110, (v) positioned to view the status of actuated valves 14, 114, 20, 120, 122. Instead of or in addition to cameras to view the rods and tools directly the condition and positions of the dials and tools can optionally be reported electronically. The monitoring apparatus can be adapted to indicate the characteristics of the sampled fluid on either a continuous or intermittent basis.

FIGS. 18*a* to FIGS. 18*f* show the arrangement of the parts which make up the skid. The sampling apparatus 100 is mounted onto a skid frame 60. Buoyancy members 92 are attached to a buoyancy frame 91 to provide stability to the ROV 200 during operation underwater.

The sampling bottles 10, 110 are connected by a sampling line which comprises a series of valves. A hydraulic supply 52 is provided at the centre of the skid frame 60 to provide a means to actuate the hydraulic valves via a hydraulic circuit. Two compensators 53 are provided to hold the pressure of the oil in the hydraulic circuit above ambient pressure. This ensures that a small leak would not result in water being allowed into the hydraulic circuit. An accumulator 54 provides a hydraulic energy to the valve circuit in the event of a power failure. A dedicated interface or control unit 56 receives all cable connections including power connections and control signals such as position indicators, valve and control actuation, and camera signals etc. The control unit 52 is in turn connected to the valve pack 52 which directs hydraulic signals to the valves accordingly. A drawer assembly extends out from each side of the skid frame 60 to access the sampling bottle 10 while onshore. The drawer assembly comprises an outer drawer 64 which houses an inner drawer 63. The outer assembly 64 slides out from the skid and the inner assembly 63 slides out from the outer assembly 64 in a telescopic manner. The sampling bottle 10 is mounted on the inner drawer 63 and may be conveniently accessed. A similar drawer assembly (not shown) is provided for the second sample bottle 110. The gauge typically remains fixed to the sample bottles 10, 110 when removed.

Figure 21:
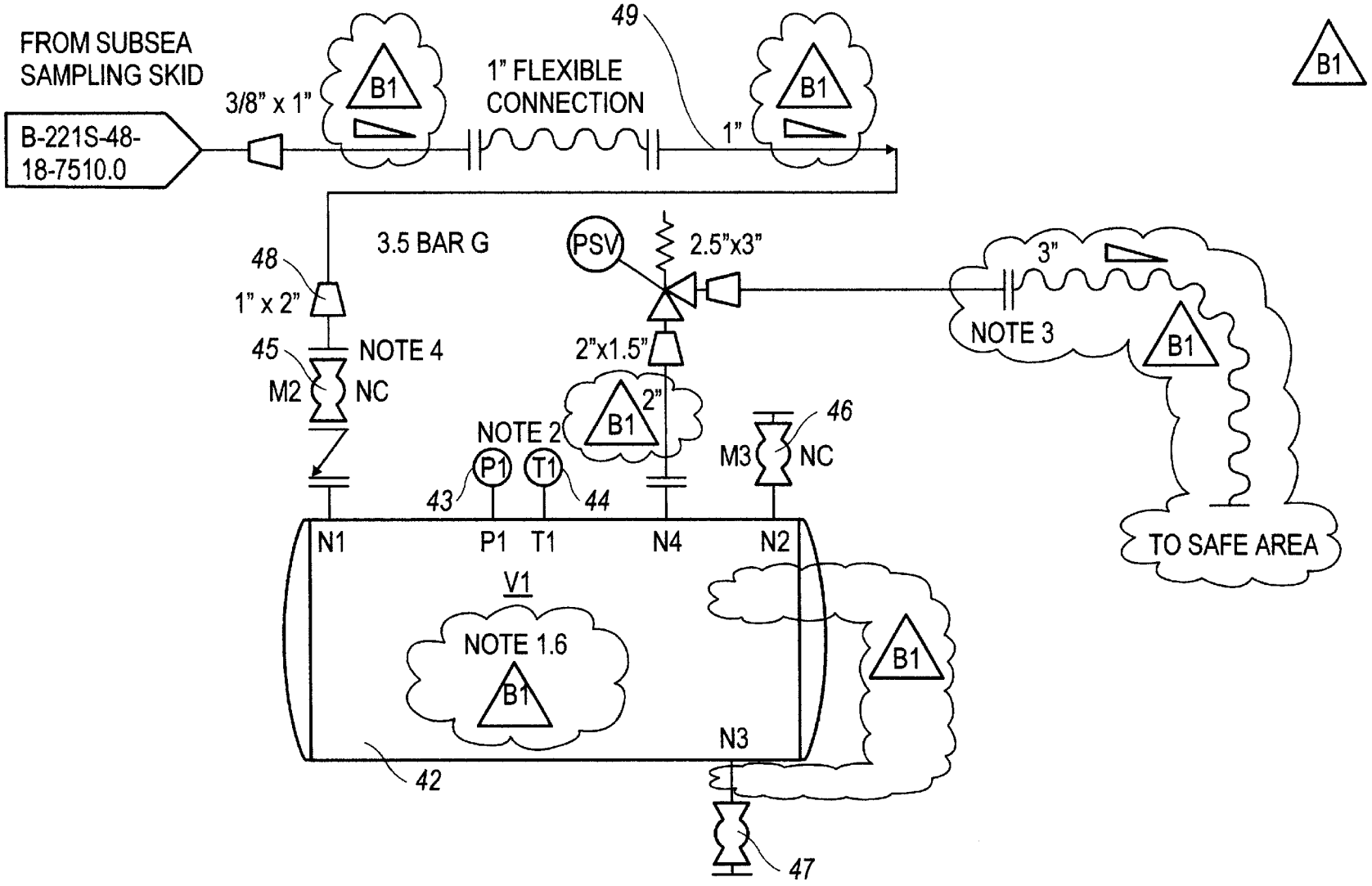
FIG. 21 is a drawing of the slops tank.
Figure 22:
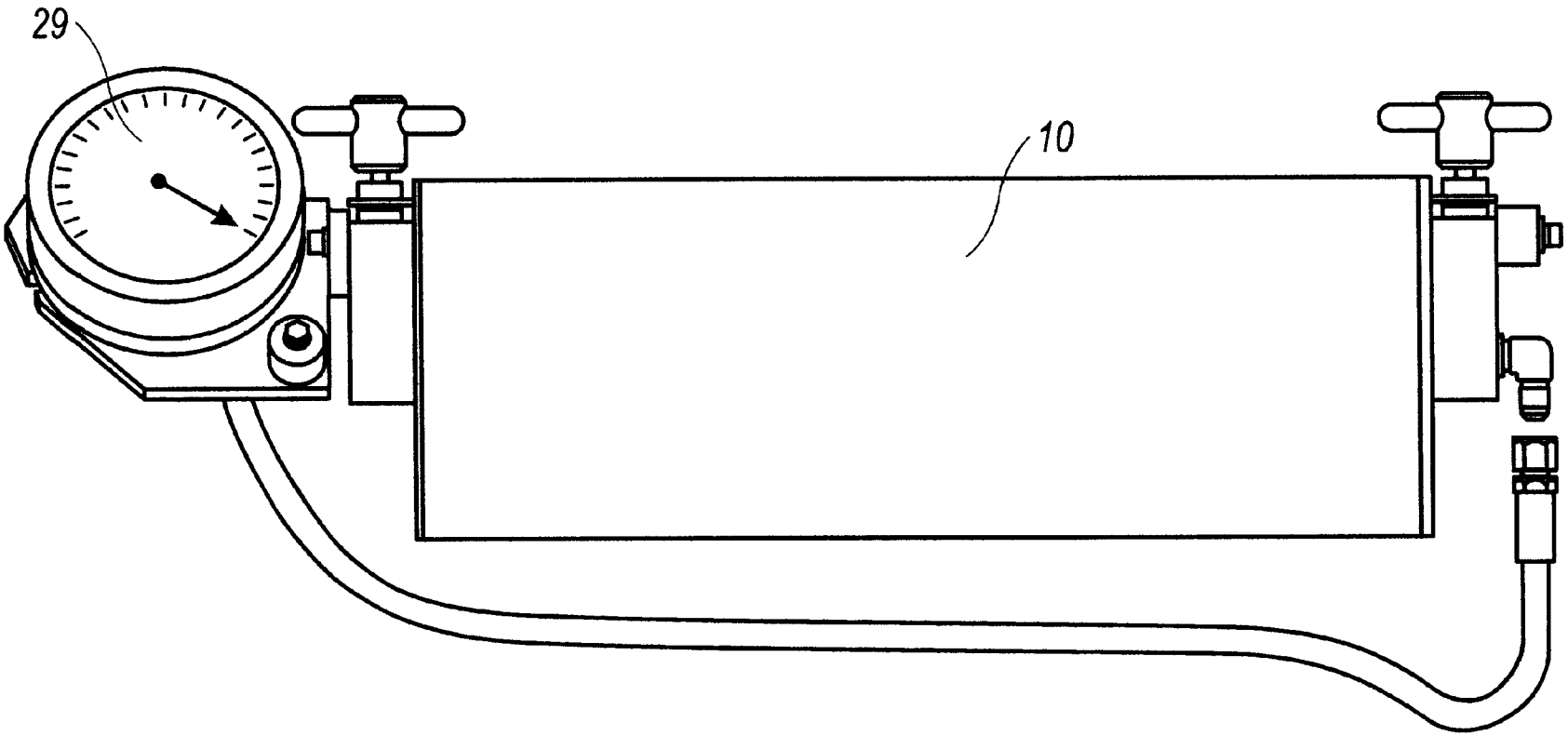
FIG. 22 is a drawing of a sampling bottle.
Figure 23:
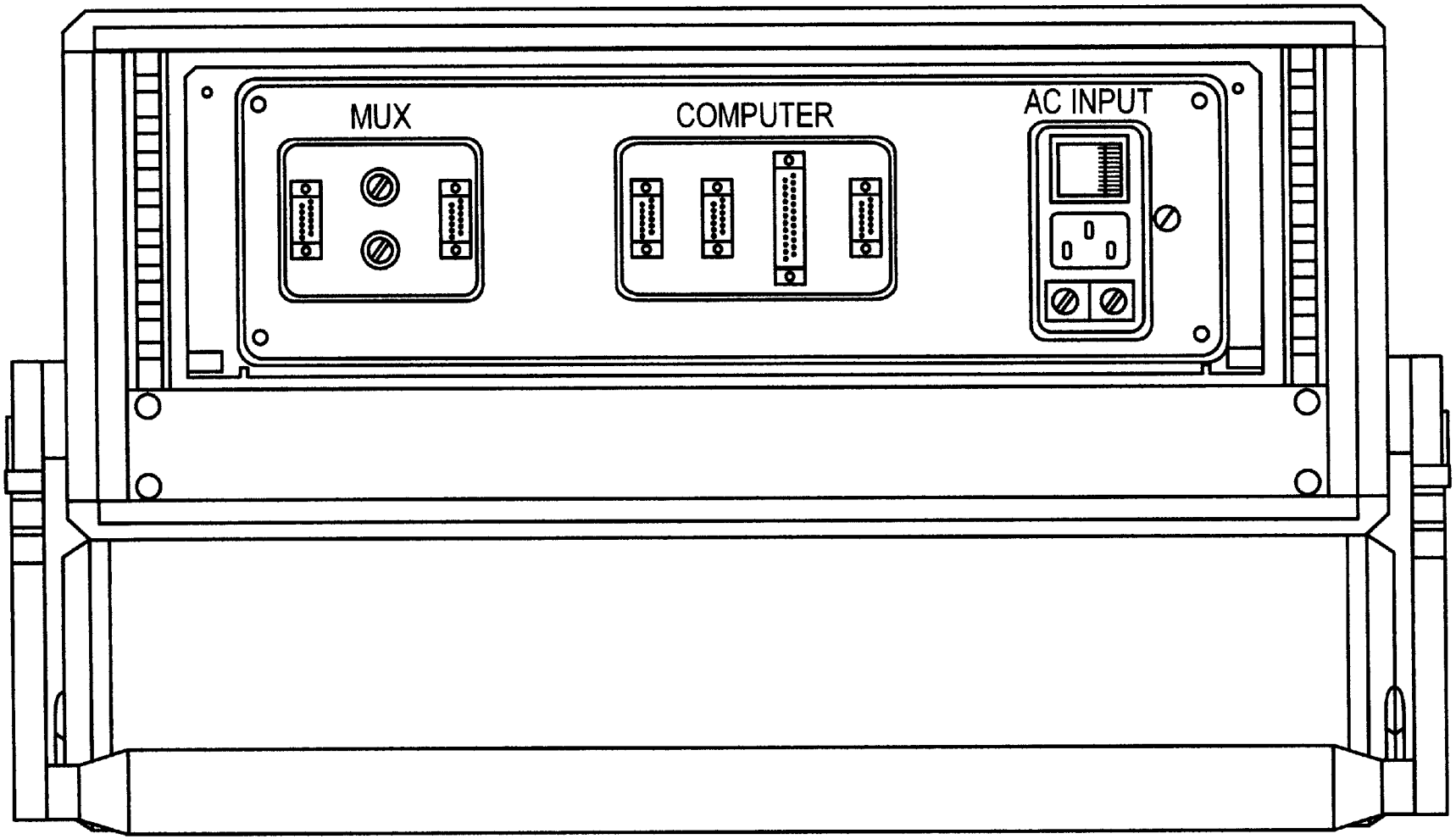
FIG. 23 is a drawing of a sampling skid control console.

When the samples have been collected from the wellhead the ROV 200 docks at the operating station and a slops tank 41 is connected to the sampling apparatus 100 by line 123 via a valve 26 and a valve 45 as shown in FIG. 21. The slops tank 41 comprises a tank 42, a pressure gauge 43, a temperature gauge 44 and three valves 45, 46, 47. In practise the first sampling bottle 10 is used to store production fluids that are drawn initially from the collection port at the wellhead, as the initial sample will generally be of fluids that are lodged static in the wellhead rather than an accurate reflection of the fluids flowing through the wellhead. Therefore the fluids from the first sampling bottle 10 will typically be expelled into the slops tank 41.

The pressure 43 and temperature gauges 44 on the slops tank 41 should be visible from manual control valve 26. A blind flange 48 is provided for positive isolation after the inlet piping 49 has been disconnected. Typically the level of the liquid in the tank 42 is measured using a portable, non-intrusive level gauge (not shown).

The sampling apparatus 100 is typically completely vented, dismantled and cleaned between offshore trips. The sampling apparatus 100 is tested prior to each mobilisation to check its integrity and to confirm there has been no degradation of components, such as steels, during storage. The first test is a hydrostatic test. The pressure of the water during the hydrotest will normally be up to 230 barg and de-mineralised water is normally used.

Figure 2A:
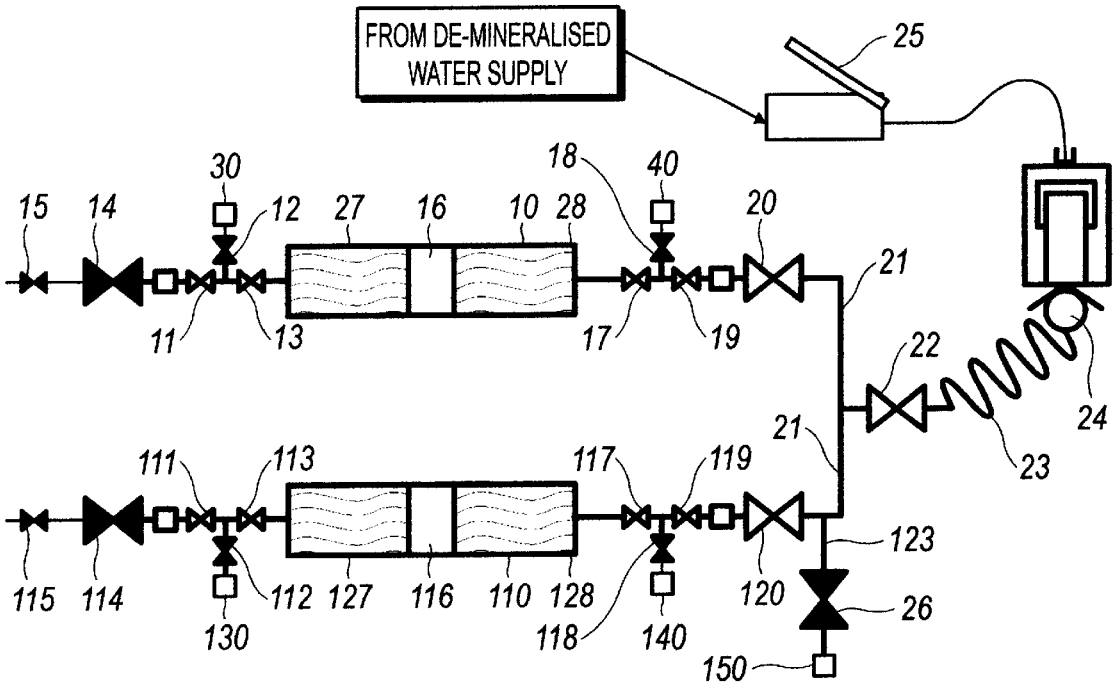
FIG. 2*a* is a drawing of the sampling equipment during the hydrotest.

In the hydrostatic test the water pump 25 is connected to the connection means 30 (not as shown) and the valve 12 is opened. Water is pumped into the first sampling bottle until the piston is pushed to approximately half way along the bottle and the valve 12 is closed. The equivalent operation is then performed for the second sampling bottle 110. That is, the water pump 25 is connected to the connection means 130 and the valve 112 is opened. Water is pumped into the second sampling bottle 110 until the piston 116 is pushed to approximately half way along the bottle and the valve 112 is closed. The male plugs 30, 130, 40, 140, 50 are removed to make the system more sensitive to leaks. The valves are then switched to the status as shown in FIG. 1. That is valves 14, 114, 12, 112, 18, 118, 126 are closed off and the remaining valves 11, 111, 13, 113, 17, 117, 19, 119, 120, 20, 22 are opened. De-mineralised water is pumped into the apparatus as shown in FIG. 2. The pressure is increased in steps up to the test pressure of 230 barg.

The water pump is then disconnected and the system left for a period of 30 mins. The pressure is monitored and any change indicates a leak.

Once the pressure test is complete valve 26 can be opened to drain and depressurise the skid. Provided a satisfactory hydrotest has been completed the gas test can now be carried out.

Figure 2B:
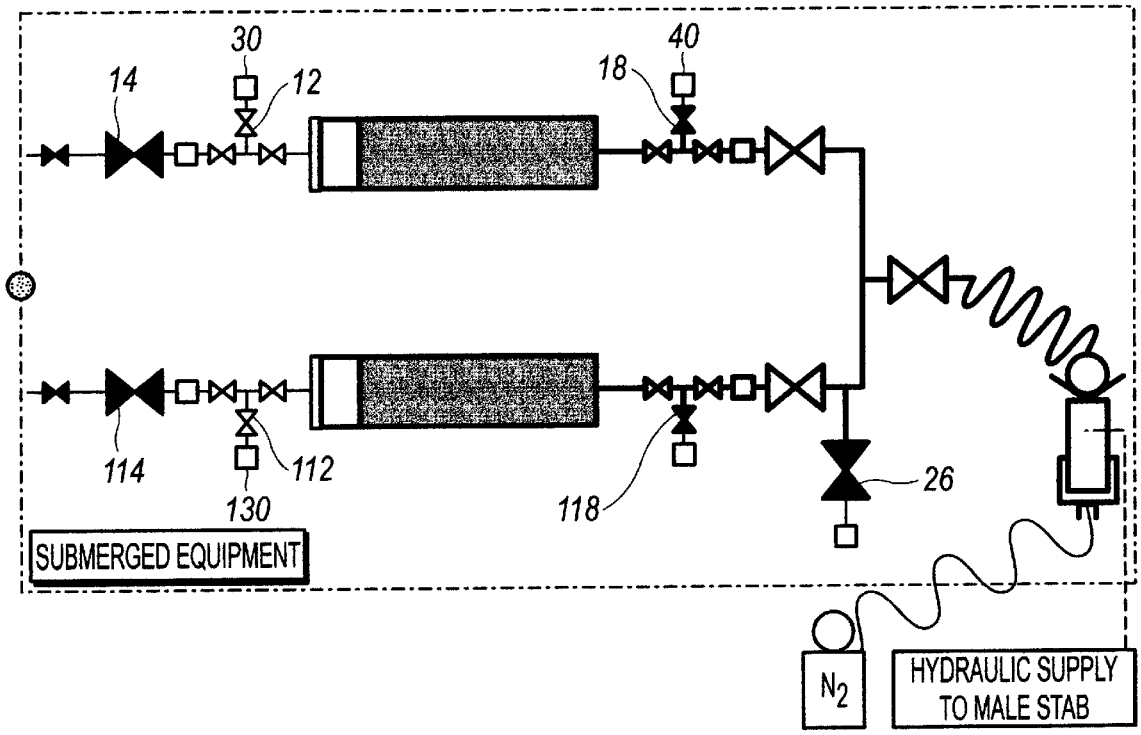
FIG. 2*b* is a drawing of the sampling equipment during the gas test.

The gas test equipment set-up is shown in FIG. 2*b*. To start the test the skid is depressurised and the valves 12, 18, 112 and 118 are opened to ensure there is no trapped pressure. Hoses are attached to connection points 30, 130. Water will be pushed out through valves 12, 112 when the pistons are pushed to the back of the bottles.

Valves 14, 114, 18, 118 and 26 are closed and valves 11,12,13,17,22,19,20,113,117,119,111,120 and 112 are open as shown in FIG. 2*b*. The system is then connected to a compressed nitrogen supply via the male/female hot stab connection 33, 34, before the skid 160 is submerged in a water bath and the nitrogen supply regulator is set to 125 barg. Hydraulic pressure is applied to open the hot stab sleeve 35, and the system is then purged with nitrogen. The pistons are checked for movement to ensure that the bottles have been purged. Water should be pushed out the back end of the bottles through the connections at 12 and 112. It is important that the pistons are against their stops at the back of the sample bottle so that the piston seals are subject to a differential pressure.

The hydraulic supply to the male hot stab is then removed in order to close the sleeve 35, and the nitrogen supply is then isolated and disconnected.

The submerged skid 160 is checked for about 30 mins for bubbles indicating leaks. If the piston seals are leaking bubbles may be seen leaving the skid from connections to the vents lines from 12 to 112.

With the skid 160 removed from the bath valve 26 is opened and the system is vented to atmospheric pressure.

Before offshore mobilisation the skid can be re-tested in order to check the integrity of all connections. The slops tank 41 is assembled as shown in FIG. 21. Valves 46, 47 are closed and valve 45 is opened.

The slops tank 41 is then filled with nitrogen via the valve 45 up to a pressure of 2.5 barg. The outlet ports from all valves are left clear so that leaks past the valves can be detected, and the skid is allowed to stabilise for a period of 10 mins. Valve 45 is closed and the nitrogen supply is disconnected while pressure is monitored for a period of 30 minutes and a soapy solution is applied to all flange joints and valve body joints to check for leaks.

If there is leakage it will most likely be past the valves or from the flanged connection on the vessel. The flanged connections may have to be re-assembled or the valves refurbished/replaced.

After the test the valve on the slops tank 41 can be released and the pressure in the tank allowed to drop until it reaches 0.1 barg.

Figure 3:
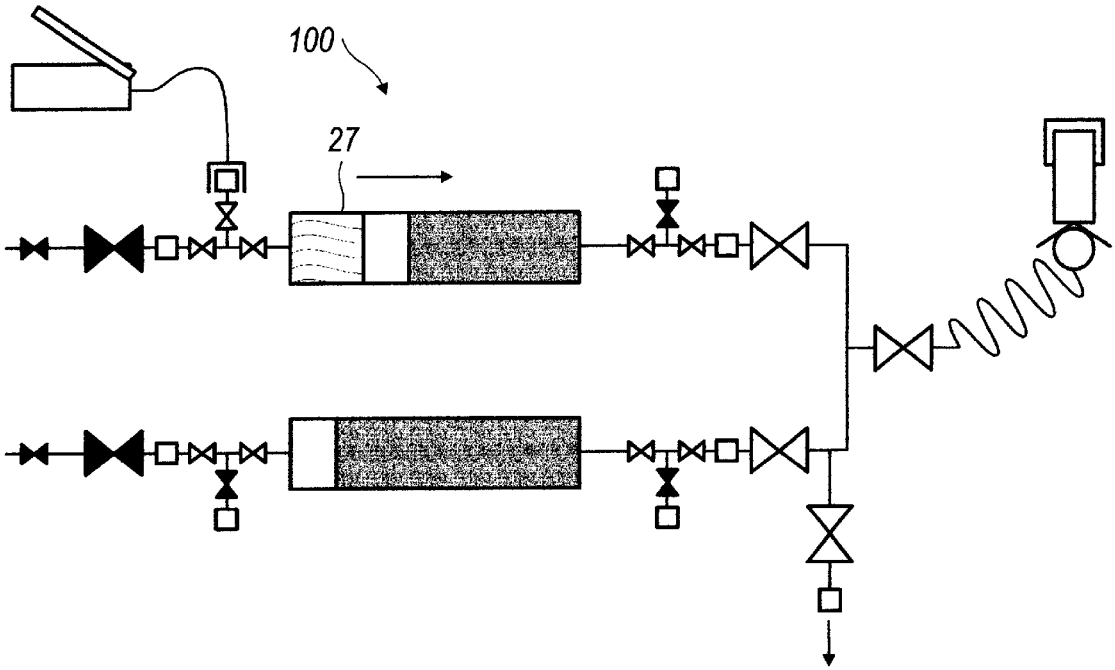
FIG. 3 is a drawing of the sampling equipment during the system purge.

To transport the skid before operation the sample bottles 10, 110 are filled with a water glycol mix according to the following procedure with reference to FIG. 3 after the tests for leaks are performed as described already.

The sampling system is vented down to atmospheric pressure. When the leak testing is complete valves 14, 114, 18, 118 and 26 are closed, and all other valves should be open.

A water/glycol supply pump is connected to the connection as 12 and fluid is pumped into the back 27 of the sampling bottle 10, checking that the piston 16 moves towards the front of the bottle.

When the piston 16 reaches the front of bottle 10 valves 12 and 20 are closed, and the water/glycol pump supply line is moved to the connection at 112, so that fluid is pumped into the back of bottle 110. When the piston 116 reaches the front 128 of bottle 110 valve 112 is closed as are valves 120, 22 and 26 in sequence.

At this point the manual needle valves 15, 115 in the vent lines from 14 and 114 should be at ¼ turn open. Pressure caps are then inserted at the exit of valves 26, 12, 18, 112 & 118, and the tubing ends at the vent lines from 14 and 114 are capped off. Valves 26, 12, 18, 112 & 118 are then locked in the closed position, and at this point the bottle pistons 16, 116 should both still be at the front end 28, 128 of the bottles.

Figure 4A:
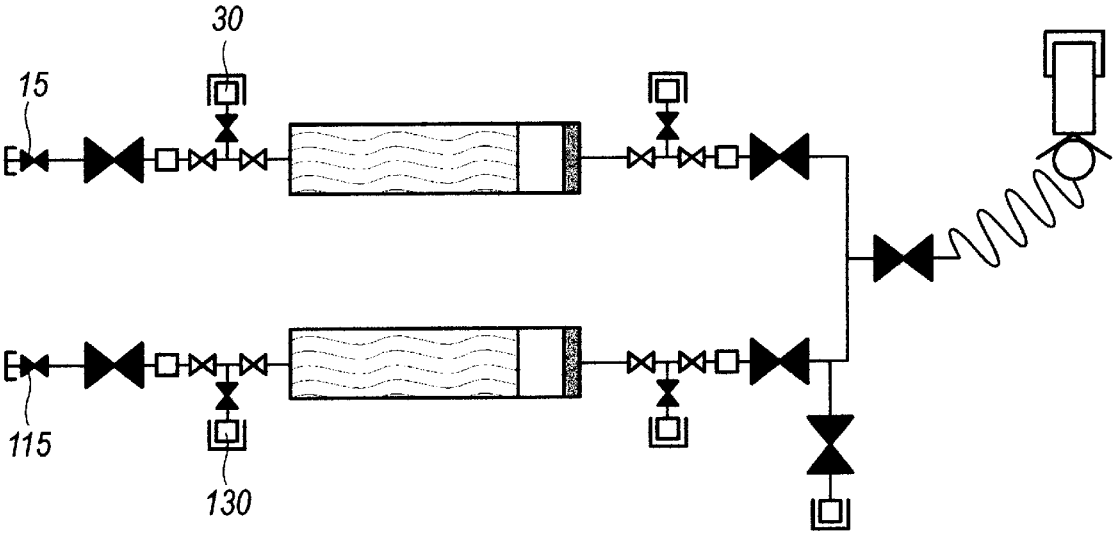
FIG. 4*a* is a drawing of the sampling equipment during transportation.

The system is now in its transport condition (refer to FIG. 4*a*). Typically the water/glycol mix will be present in the sampling bottles when the ROV 100 and attached skid 160 dives.

Spare sample bottles are provided and require to have the production fluid side flushed with de-mineralised water. These bottles should be separately hydrotested to 230 barg and nitrogen tested to 125 barg to test the piston seals and valves.

Figure 4B:
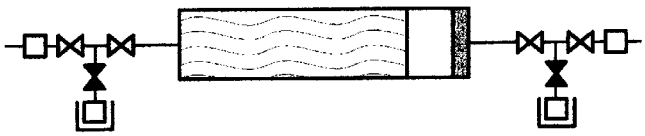
FIG. 4*b* is a drawing of the spare sampling bottle during the transportation.
Figure 5:
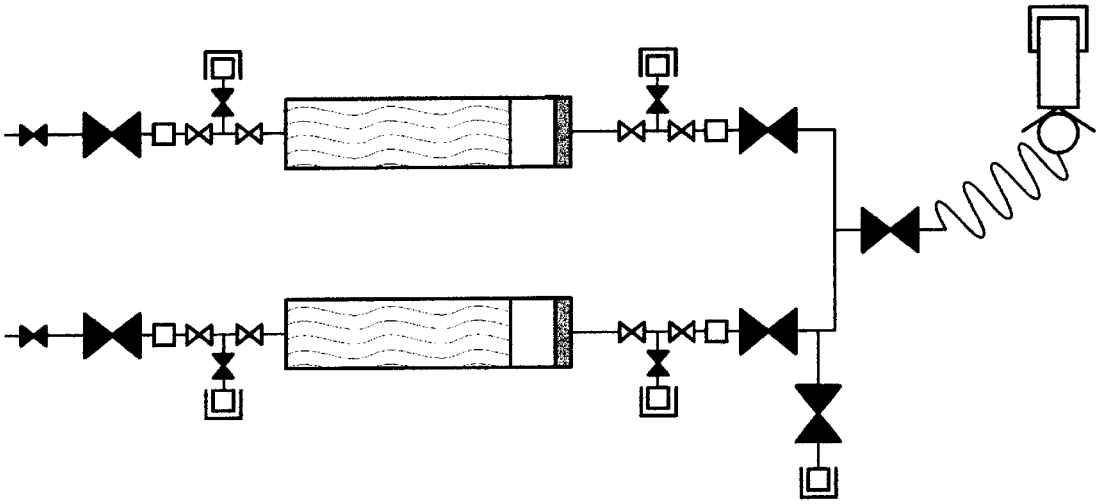
FIG. 5 is a drawing of the sampling equipment prior to diving.

The back end 27, 127 of each of the bottles 10, 110 is filled with the water/glycol mix so that the piston 16, 116 is at the front 28, 128 of the bottle. All valves on these bottles are left in the CLOSED position (refer to FIG. 4*b*).

In use for sampling operations, the ROV 200 flies to the wellhead and docks at a panel (not shown). The docking probes 71, 72 are inserted and the ROV 200 is stabilised. The male hot stab 33 on the mounting bracket 64 is aligned with and inserted into the female connection 34 on the wellhead. The grabber tool 63 then releases the hot stab tool 33 and the lower carriage of the tool deployment unit is withdrawn.

Samples are then removed from the wellhead as follows: The current inlet pressure to the manifold flowmeter is checked and recorded with a central processing facility. The pressure can typically be read from the pressure transmitter at the inlet to the flowmeter or from the transmitter within the flowmeter. The operating pressure read at the manifold should not be greater than 97 barg. However, as the accuracy of the subsea manifold gauges cannot be guaranteed a sample may still be taken even if the manifold gauge reading is greater than 97 barg.

Figure 6A:
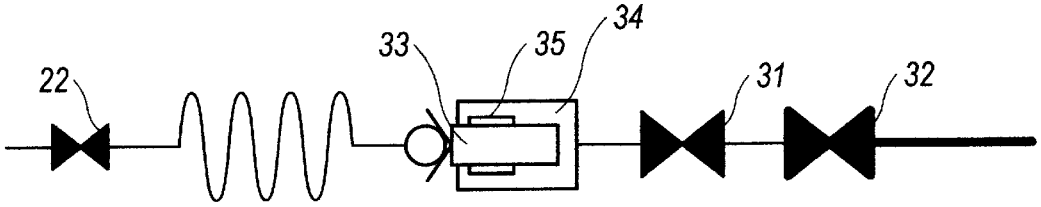
FIGS. 6*a* to 6*d* are drawings of the sampling equipment after docking at the panel.
Figure 6B:
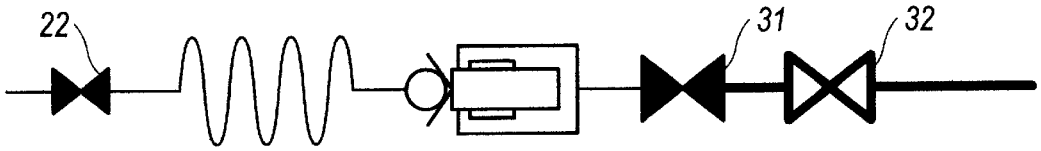
Figure 6C:
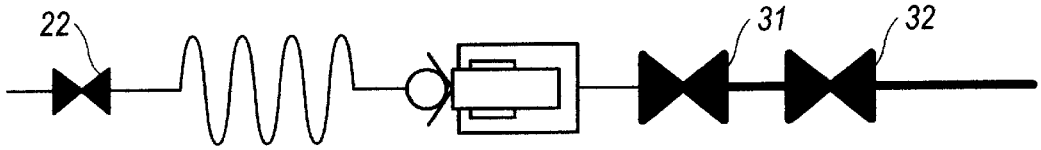

The panel valves should be configured as shown in FIG. 6*a*. Hydraulic pressure is applied to the male hot stab in order to push back the sleeve 35. The sample isolation valves 31, 32 on the panel are operated using the low torque tools 61, 62. Sample Isolation Valve 32 is opened (FIG. 6*b*) to admit the sample into the collecting device and then closed. Thus the pressure between the two sample isolation valves 31, 32 will be the flowmeter operating pressure as determined from step 2 (FIG. 6*c*).

Figure 6D:
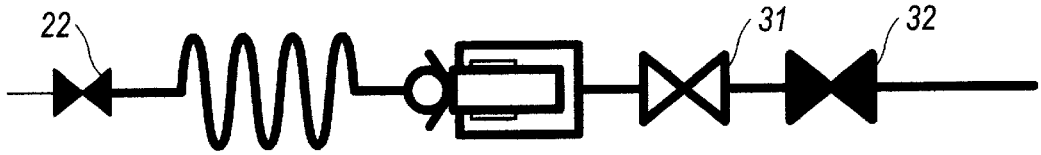

Sample Isolation Valve 31 is opened to expose the hot stab connection to pressure whilst still providing isolation between the flowmeter and the hot stab (FIG. 6*d*). Preferably the operator should observe that there is no fluid leakage from the hot stab. If there is fluid leakage then Sample Isolation Valve 31 is preferably closed and the sampling operation must be re-attempted after the hot stab connector is checked. In this case the hot stab sleeve 35 is closed and removed while the ROV 200 undocks from the panel and is recovered the surface where the Sample Isolation Valve 32 is opened.

Preferably the XYZ tool position at the Sample Isolation Valves 31, 32 is maintained. This enables quick isolation of the line to be made should any problems be encountered.

Figure 7:
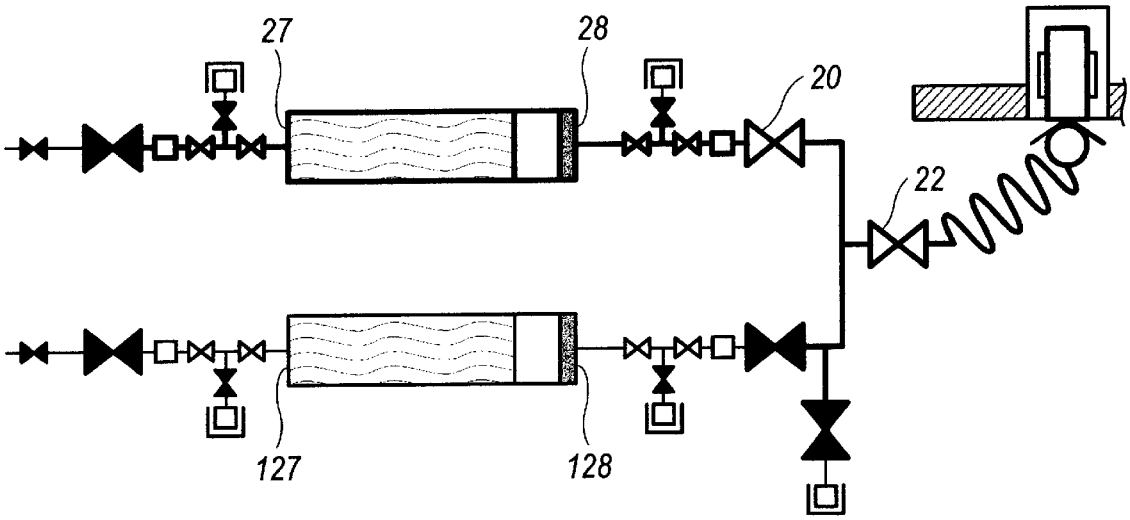
FIG. 7 is a drawing of the sampling equipment at the start of the sampling operation.
Figure 8:
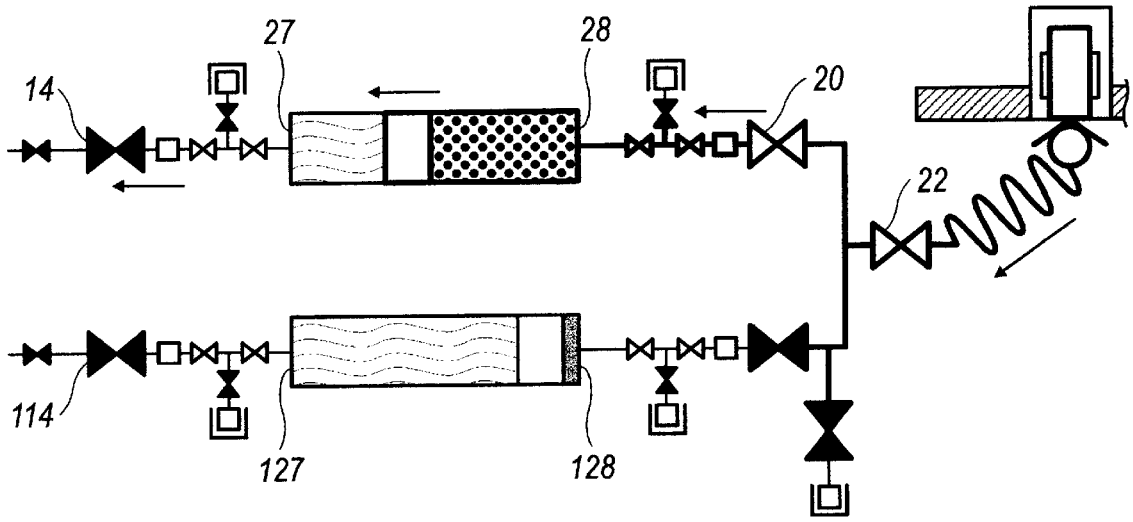
FIG. 8 is a drawing of the sampling equipment during operation.

Valves 22 and 20 are then opened as shown on FIG. 7. This will expose bottle 10 to the operating pressure. Check that the pressure gauge on bottle 10 indicates the pressure of the sampled fluid, and valve 14 is then opened. This will allow the water/glycol mix to exit from the back 27 of bottle 10 and production fluid into the front 28 (as shown on FIG. 8). The time taken for the piston to move from the front 28 to the back 27 of the sample bottle is recorded. The typical time taken for a 5 litre sample is set out in the table below.

| Manifold Pressure (Barg) | Time to take sample (mins) |
|---|---|
| 37 | 30 |
| 50 | 28 |
| 97 | 22 |
| 230 | 15 |

The bottle 10 fills with fluid under pressure from the manifold and the fill can confirmed by the piston position indicator. When the piston stops moving the pressure shown on the bottle gauge should increase up to the manifold pressure.

If after 5 minutes the bottle piston has not moved it must be assumed that there is some form of blockage in the line such as a build up of hydrates. In this case the sampling operation may be abandoned. In this case the valves 22, 120 and 31, 32 are closed, and the ROV 200 undocks from the panel and is recovered to the surface.

In the event of satisfactory fill, the valves 20,14 are closed when the piston moves to the back of the bottle.

Valve 120 is opened and the pressure gauge on the bottle 110 is checked to indicate the pressure of the sampled fluid.

Valve 114 is then opened and the time taken for the piston to move from the front 128 to the back 127 of the bottle is recorded. Typically the time to taken for the second bottle 10 to fill will be similar to the times given for the first sampling bottle 10.

As the sampling bottle 110 is filled with fluids from the wellbore at its first end 128, the water/glycol mix is expelled from its second end 127. A throttle (not shown) may be provided to control the rate at which the water/glycol is expelled and so control the rate the sample fluids are introduced into the sample bottle 110. A more representative sample of the fluids in the wellhead is typically recovered in this controlled fashion.

When the bottle is full the piston rod 139 will be fully extended and the pressure shown 129 on the bottle gauge will increase to the manifold pressure.

Valves 120, 114, 31, 32 and 22 are closed in that sequence and hydraulic pressure is removed from the male hot stab 33 in order to close the sleeve 35. The hot stab 33 is removed from the female connector 34.

Figure 9:
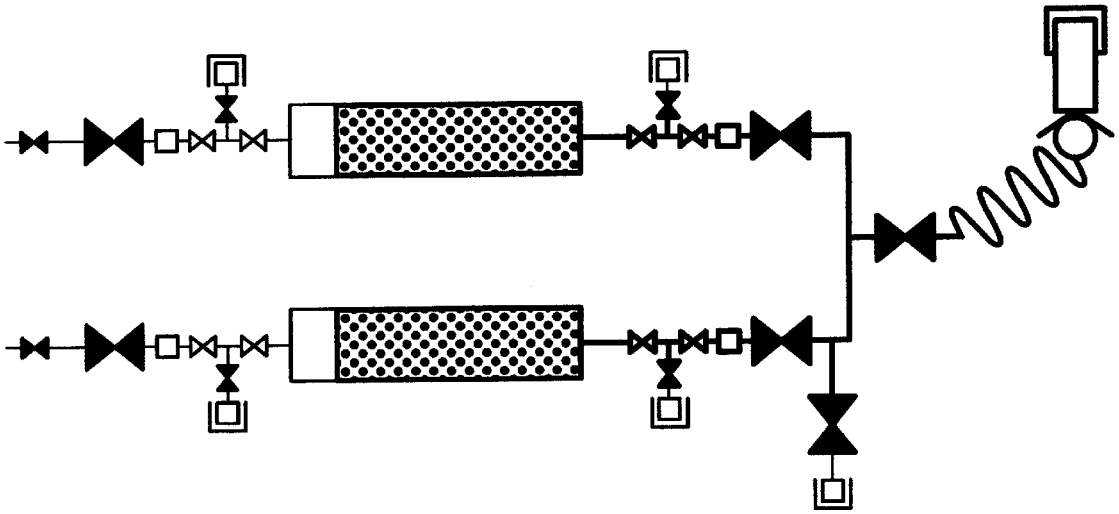
FIG. 9 is a drawing of the sampling equipment after operation.

The docking probes can be released and the ROV 200 may undock the from panel. The sampling equipment should now be configured as shown in FIG. 9.

The ROV 200 is then brought back to the rig or other operating station where the sampled fluid is recovered.

The actual arrangement of equipment can vary according to the ROV 200 and other factors. Gravity is sometimes required to assist the flow of fluids from the sampling skid to the slops tank and the arrangement of the equipment on the vessel can optionally take account of this. Typically the slop tank should be located on the deck of the vessel such that the flexible vent line from the safety relief valve can extend over the edge of the vessel. The end of the flexible should preferably be situated such that it is not adjacent to any intakes, exhausts or ignition sources. The vent line should typically be secured to the side of the vessel and the area around the line roped off to personnel. The weather conditions at the time of the sampling operation should also be taken into account. This may necessitate re-locating the vent hose end.

If possible the ROV 200 launch/recovery platform should be located at a higher elevation than the top of the slops tank 41. This is to allow the waste fluids from the skids to flow into the slop tank 41.

The slops tank 41 should be positioned during transport such that it is within reach of one of the vessel cranes. This is so that, if necessary, the sampling skid can be lifted above the slops tank 41. This may be required to give the necessary height above the slops tank 41 if this cannot be achieved from the ROV 200 launch/recovery station.

The slops tank 41 should be located sufficiently close to the ROV 200 launch/recovery station such that the hose used for venting operations can reach between the connection points at 26 on the skid and the valve (not shown) on the slops tank 41.

After recovery to the surface the bottle containing the production sample is removed from the skid. The replacement of sample bottles will generally be carried out with the skid on the deck. To this end each sampling bottle 10, 110 is mounted on a drawer assembly 63, 64 and can be conveniently accessed. It is suggested that the connections to the ROV 200 are maintained so that hydraulic power is available to operate the actuated valves. However, if the ROV 200 is urgently required for other tasks then the skid can be disconnected from the ROV 200 and the manual overrides on the actuated valves used. This can be achieved using a hydraulic hand pump via a manual switching circuit on the skid or by a screw to maintain the piston on the valves in a closed position, so that individual valves an be physically closed. All actuated valves will typically fail in the closed position when the hydraulic supply is removed. The hot-stab comprises a spring return mechanism which will activate when the cylinder has been vented and so does not require hydraulic power to in order to open it.

The pressure shown on the bottle gauges is checked. If either bottle contains fluid at greater than 97 barg then this is outwith normal operation conditions and the bottles cannot be vented as detailed below. This is due to the excessively low temperatures that would be produced when venting fluids of this pressure to the slops tank 41. These abnormal pressures are likely to be as the result of a process upset and further sampling should not be carried out until the cause of this upset is determined. If the sampling operation is to be continued then the two bottles containing the high pressure production fluids will have to be removed and new bottles inserted will be described later.

As bottle 10 will be used for each sampling it must be vented and re-filled with water/glycol between each run. Venting the skid makes use of the slops tank 41. The following checks should be made each time the slops tank 41 is used:

Valves 45, 46 and 47 should be closed. This is particularly important the first time the tank is used offshore as it will have been filled and purged with nitrogen before shipping. If valves 46 or 47 are found to be open then the slops tank 41 must be re-purged before use. Pressure in the tank should not be greater than 2.0 barg prior to each filling operation.

Temperature of the tank should be in the range −6° C. to +50° C.

The tank level indication on the ultrasonic level detector is then checked. Level of the fluid in the tank should be 200 mm or less. The vent piping from the pressure safety valve should be attached and discharged to a safe area. The end of the vent piping should be free from blockages. The hose used to connect to the sampling skid should be in good condition and the end connection should be checked for debris.

In order for the production fluids to be drained from the skid should typically be at a higher elevation than the slops tank 41. If the ROV 200 launch platform is located above the top of the slops tank 41 level then the skid should be kept on the ROV 200 and the hydraulic supply can be used to actuate the valves. Ideally the operator at the ROV 200 location should be able to view the pressure and the temperature gauges on the slops tank 41 while valve 26 on the skid is being operated. If this is not possible the operator at the skid should preferably have a clear view to the slops tank 41 and a second operator should be stationed at the slops tank 41 to monitor the gauges.

If the ROV 200 launch/recovery station is not at a higher elevation than the top of the slops tank 41 then the skid may have to be removed from the ROV 200 and lifted above the slops tank 41. The following steps must be taken:

1. Close all valves on the skid.
2. Vent down all the hydraulic connections to the skid (actuated valves and hot stab).
3. Disconnect all hydraulic and electrical lines from the ROV 200.
4. Remove the skid from the ROV 200.
5. The skid can now be moved by its lifting points to a location at a higher elevation than the slops tank 41.

The manual overrides on the hydraulic valves will now have to be used to operate them. The operator should be able to view the pressure 43 and temperature 44 gauges on the tank while valve 26 is being operated. If the ROV 200 launch/recovery station is at a higher elevation than these steps are not necessary. Regardless of the position of the ROV 200 launch/recovery station, the following steps should be taken.

Valves 111, 113, 117 and 119 should be closed and valves 11, 13, 17 and 19 should be opened.

Valve 26 should be closed, and any pressure released from behind the plug at 26 before it is removed. The plug 50 is then backed off and the cap is depressed to vent any trapped pressure. Once the plug 50 is removed the hose is connected from the connection at valve 26 to the slops tank 41. Valve 45 on the slops tank 41 is then opened, as is valve 26 (slowly) until fluid is heard to escape through the valve to the slops tank 41 (the valve will have to be unlocked first). The valve will reach extremely low temperatures while the fluid vents through it. The pressure and temperature in the slops tank 41 should be monitored at all times when 26 is open. The slops tank 41 pressure should be kept below 2.5 barg. If the temperature falls below −25° C. than valve 26 should be closed, and the temperature allowed to return to above −25° C. before valve 26 is opened again.

Figure 10:
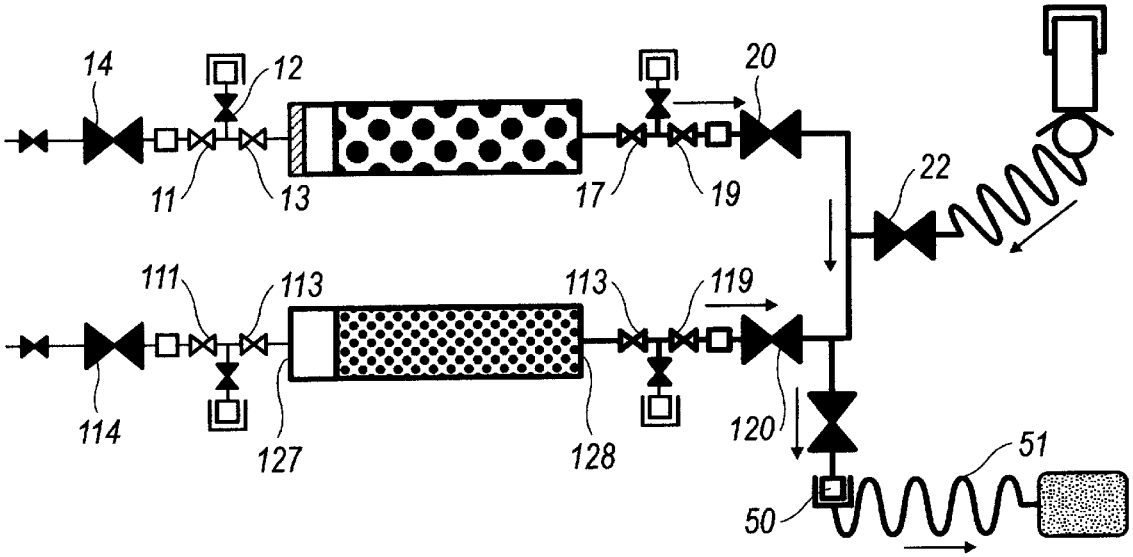
FIG. 10 is a drawing of the sampling equipment during venting of the first sampling bottle.

Valve 22 is opened, then 120, then 20; this will vent the contents of bottle 10 to the slops tank 41. The system will then be configured as shown in FIG. 10. The pressure and temperature in the slops tank 41 is then monitored recorded and maintained within limits stated above.

Valve 14 is opened and the water/glycol supply pump is connected to the connection point at 30. Valves 22 and 120 are then closed.

Figure 11:
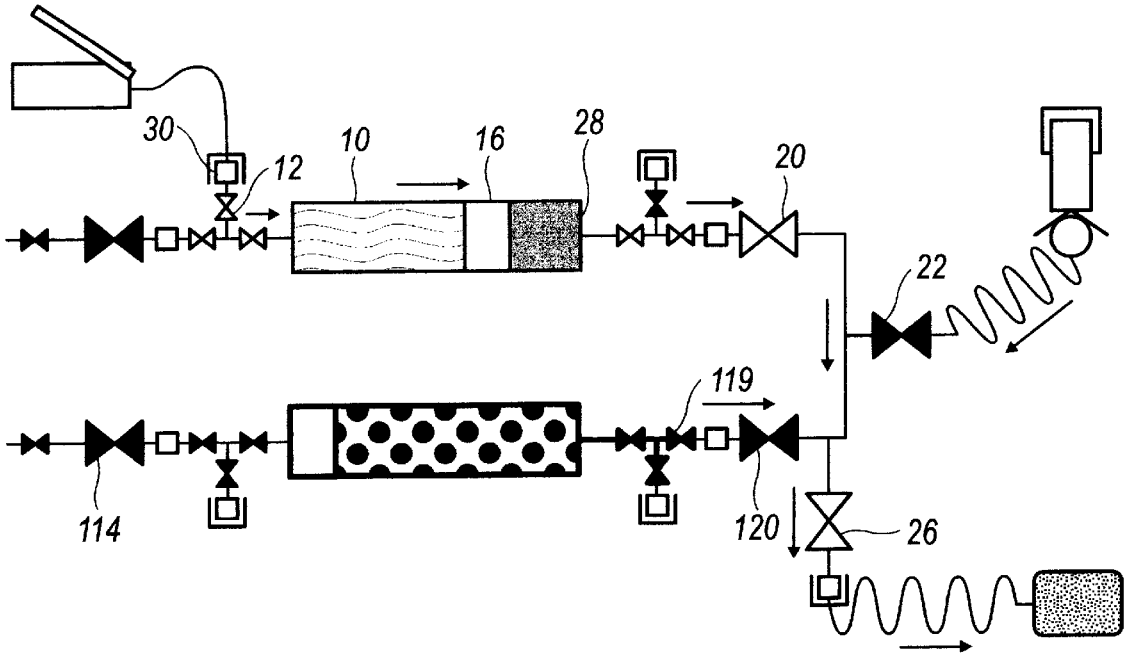
FIG. 11 is a drawing of the sampling equipment during purging of the sampling bottle with water/glycol.
Figure 12:
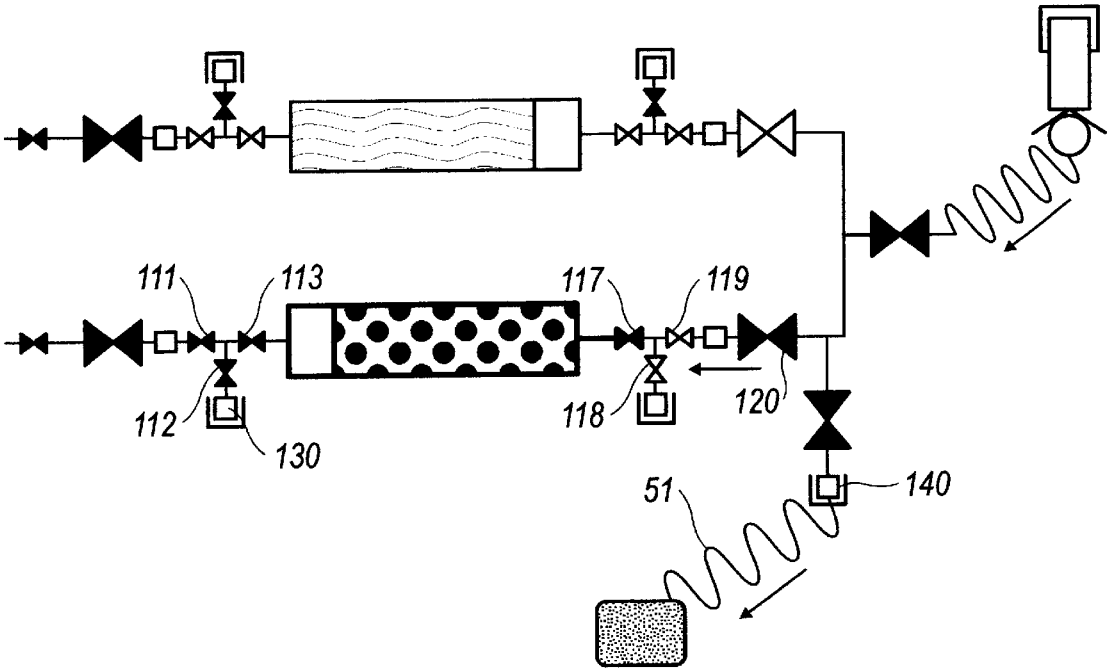
FIG. 12 is a drawing of the sampling equipment prior to removal of the second sampling bottle.
Figure 13:
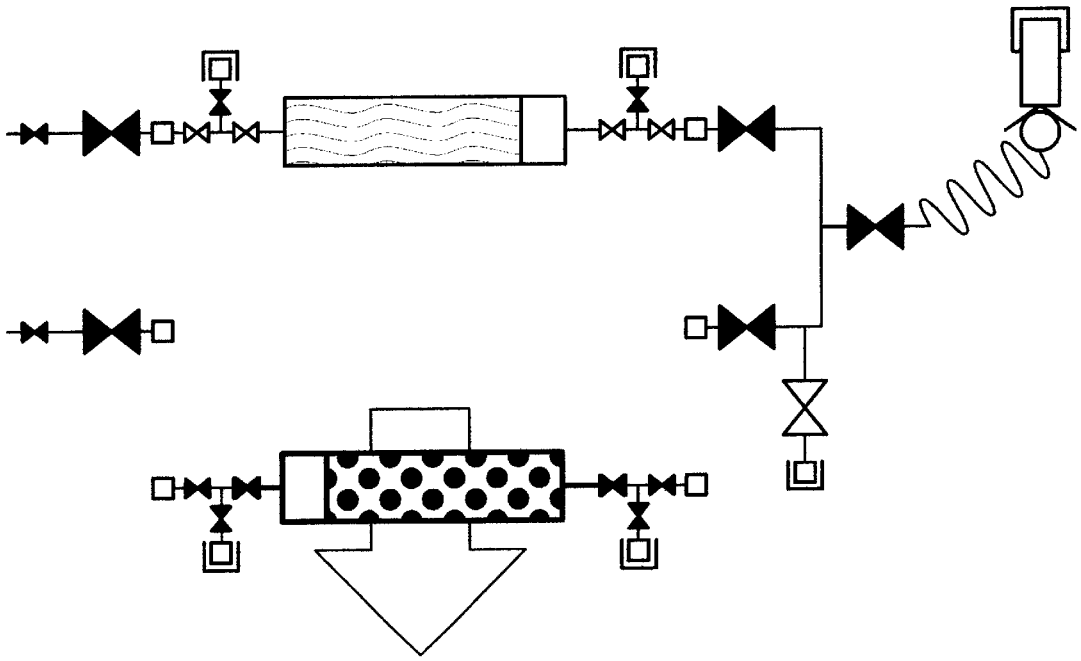
FIG. 13 is a drawing of the sampling equipment during removal of the second sampling bottle.

Valve 12 is then opened and water/glycol is pumped into the back of bottle 10, checking that the piston 16 moves towards the front of the bottle 28. Production fluid will be expelled through the connection at valve 26 into the slops tank 41 as shown in FIG. 11.

When the piston 16 reaches the front of bottle 10 valve 12 is closed. Valves 26 on the sampling skid and 45 on the slops tank 41 are then closed.

At this point, the bottle 10 has been vented but the section of pipework between valves 119 and 114, including bottle 110, is still at pressure.

The bottle 110 should now be removed. Before bottle 110 can be removed the pressure either side of the bottle must be vented, by closing valves 113 and 117, backing off the plugs 130 and 140 and then depressing the cap to release any trapped pressure before removing the plugs. Valve 120 is closed, and the slops tank 41 hose is connected to the connection point 140.

Valves 45, 119 and 118 are opened sequentially to vent the section of pipe between valves 117 and 20. There should only be a small release of fluid from this small section of pipe. If there is continual fluid release and the pressure in the bottle falls then this indicates valve 117 is passing. Valves 118 and 119 should in that case be closed, and the bottle can only be removed if it is first completely vented to the slops tank 41.

Valves 45, 118 and 119 are closed sequentially, and the hose to the slops tank 41 is disconnected from valve 118.

The fluid at the back end of bottle 110 will be at the hydrostatic water head pressure when the sample was taken (around 10 barg for 100 m depth). This pressure must be vented before the bottle can be removed.

The slops tank 41 hose is connected to the connection 130, and the valves 45 and 112 are opened. The bottle is still isolated by valve 113. If the pressure in the bottle falls when valve 112 is opened then this indicates both the bottle piston seals and valve 113 are passing. In this case the bottle must be completely vented to the slops tank 41 before it can be removed. This should be done through valves 117 and 118.

Valves 111 and 114 are opened, and valve 45 on the slops tank 41 is closed before the hose 51 to the slops tank 41 is disconnected. Valves 111, 112, 118 and 119 are closed (Valves 113 and 117 should already be closed).

Valves 120 and 26 are then opened to ensure both the points where the bottle connects to the skid are open to atmospheric pressure. Bottle 110 still contains production fluids at pressure and so should be handled with care. Bottle 110 is disconnected.

A new bottle to be inserted should be pre-filled with the water glycol mix at the back of the sample bottle. The double block and bleed valves either side of the bottle should be closed. The piston should be at the front of the bottle and the pressure gauge should read zero. The new sampling bottle should then be fitted to the skid, checking that valve 119 connects to 120 and 111 connects to 114.

The pipework between the hot stab and the sampling bottles will have to be flushed through to prevent contamination between samples. De-mineralised water is preferably used for the flushing operation in order to avoid contamination of samples. Tp The skid valves should be configured as below:

| Closed Valves | | Open Valves |
|---|---|---|
| 11 | 22 | 17 |
| 12 | 120 | 19 |
| 13 | 20 | 117 |
| 18 | 26 | 118 |
| 111 | 14 | 119 |
| 112 | 114 | |
| 113 | | |

There are three legs of pipework on the skid that must be flushed through. The hot stab and check valve must be disconnected and flushed in the flow direction due to the presence of the check valve. Thus there are four sections to be flushed; labelled A, B, C and D on FIG. 14.

Figure 14:
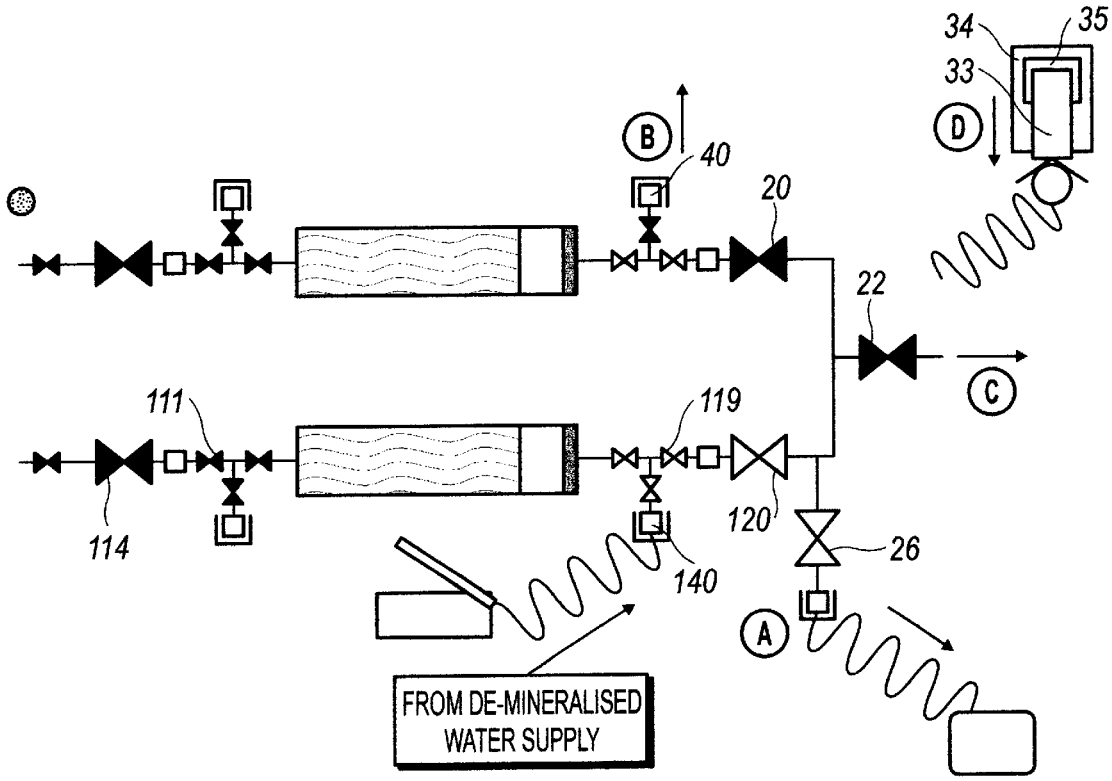
FIG. 14 is a drawing of the sampling equipment during the flushing operation after insertion of a fresh sampling bottle.

The de-mineralised water pump is connected to the connection point 140 as shown in FIG. 14, and a hose from the connection at valve 26 is connected to a suitable receptacle. Valves 26 and 120 are opened and the system should now be configured as shown in FIG. 14. De-mineralised water is then pumped through the pipework, and fluid will exit from the hose at 26 to be collected in the receptacle. Pumping is continued until the fluid exiting 26 is clean, at which point valve 26 is closed, valve 20 is opened, and the hose is moved from 26 to 40. Valve 18 is then opened and de-mineralised water is pumped through the pipework, with fluid draining from 18 and pumping continuing until the fluid exiting is clean. At that point, valves 18 and 20 are closed and valve 22 is opened, the hot stab and check valve are disconnected from the rest of the skid at the QC coupling.

The hose is transferred from 30 to the QC coupling, and de-mineralised water is pumped through the pipework, draining through the hose at 22, until clean, whereupon the water pump is disconnected from the skid, the hot stab is inserted into the dummy female receptacle, the water pump is connected to the connection on the female stab 34, the hot stab sleeve 35 is opened by hydraulic pressure and de-mineralised water is pumped through the hot stab and check valve, until clean.

The water pump is then disconnected from the female stab 34, and valves 22 and 26 are closed.

The skid pipework is then purged with nitrogen prior to each sampling run. This will be done to remove air from the pipework prior to the introduction of hydrocarbons.

Figure 15:
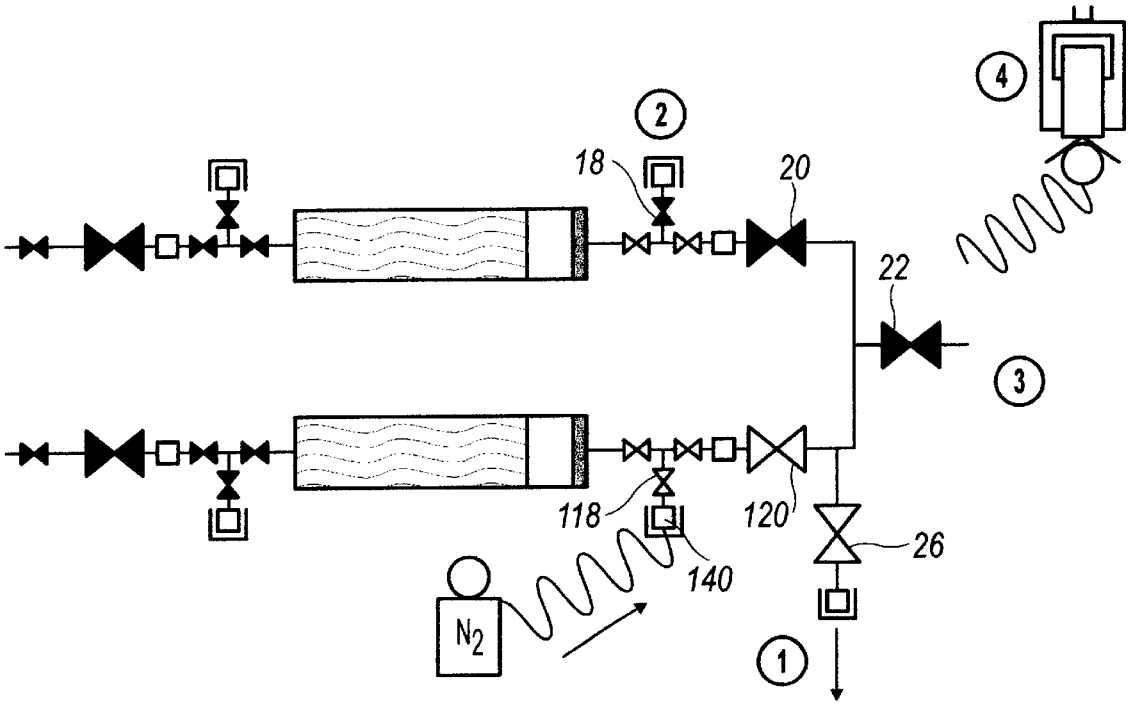
FIG. 15 is a drawing of the sampling equipment during the during the purging operation after insertion of a fresh sampling bottle.

The nitrogen supply is connected to the connection point 140 as shown in FIG. 15. Valves 26 and 120 are opened and the system should now be configured as shown in FIG. 15.

The nitrogen supply is opened and the system is purged through for a few seconds. Fluids will exit from the connection at 26.

Valve 26 is then closed, and valves 20 and 18 are opened. After a further nitrogen purge for a few seconds fluids will exit from the connection at 18.

Valves 18 and 20 are closed, and valve 22 is opened.

After a further nitrogen purge, fluids will exit from the end of the hose where the check valve and stab are normally attached.

Valves 22 and 118 are closed and the nitrogen supply is disconnected from the skid and connected to the connection on the female stab 34.

The hot stab sleeve 35 is opened by hydraulic pressure, purged with nitrogen for a few seconds and closed before the check valve and stab are re-connected to the skid pipework.

Figure 16:
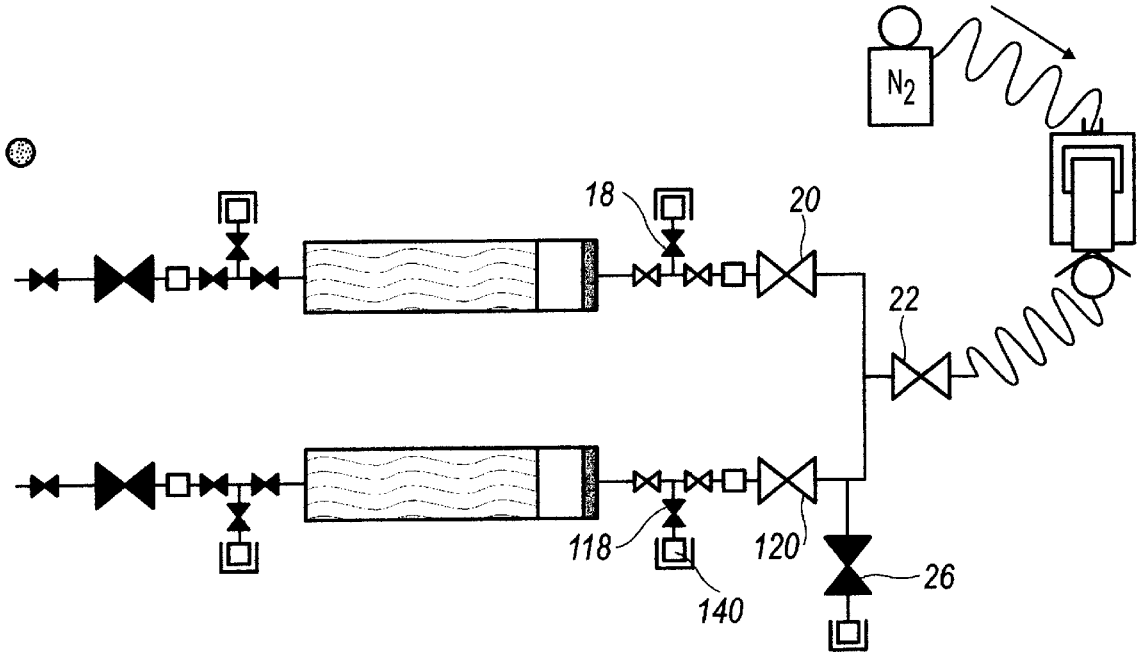
FIG. 16 is a drawing of the sampling equipment containing nitrogen.

Hydraulic pressure is then applied to open the hot stab sleeve 35, and checking that valves 18, 118 and 26 are closed, valves 22, 120 and 20 are opened. The system should be configured as shown in FIG. 16.

A nitrogen purge is generally conducted in two steps to achieve a nitrogen purity of 99.9% of volume in the skid pipework. Typically the piping is filled with nitrogen to a pressure of 15 barg, and the nitrogen supply is isolated.

Valve 26 is opened to vent the nitrogen, and then closed.

The nitrogen supply is then opened and nitrogen fills the piping to a pressure of 15 barg, after which the nitrogen supply is isolated and the pipes are vented by opening and closing valve 26.

As the connections between bottle 110 and the rest of the pipework have been broken they must be re-tested before another sample can be taken as follows: the nitrogen supply is connected to the connection point at valve 118 and the nitrogen supply regulator is set to 125 barg. At this point the bottle piston 116 should be at the front 128 of bottle 110 and the bottle and piping behind the piston 116 should be filled with the water/glycol mix.

Figure 17:
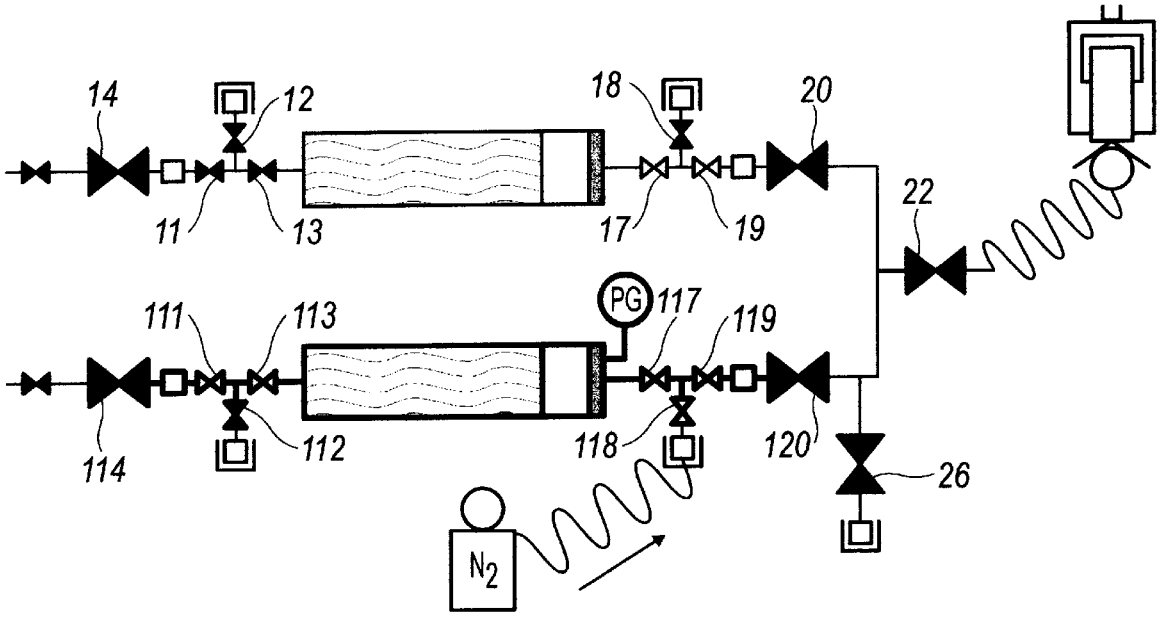
FIG. 17 is a drawing of the sampling equipment during the a leak test.
Figure 18A:
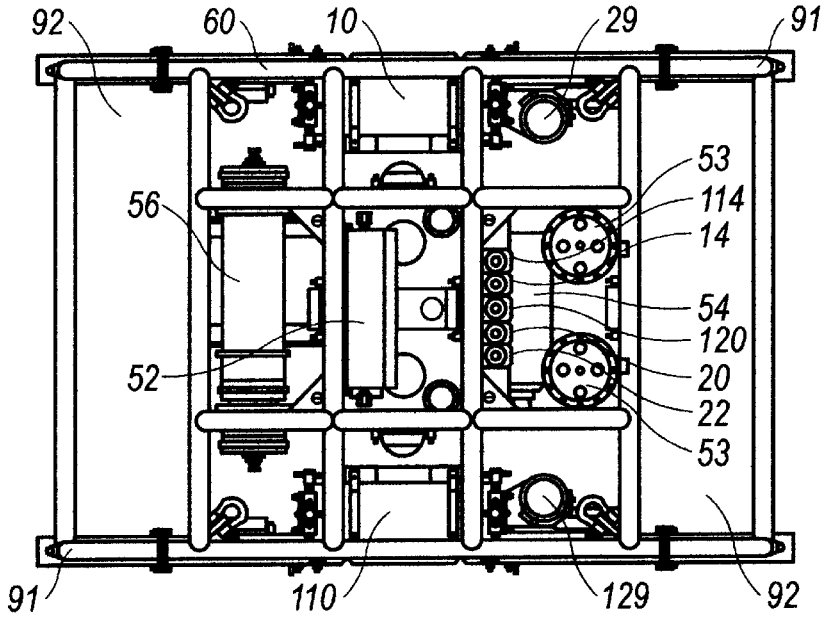
FIGS. 18*a–f* are general arrangement of a skid containing the collecting device.
Figure 18B:
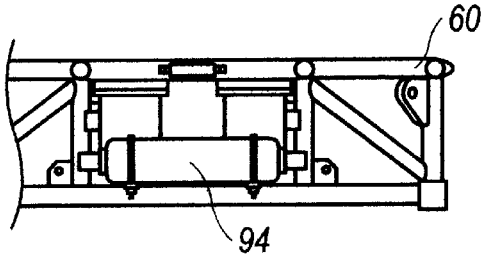
Figure 18C:
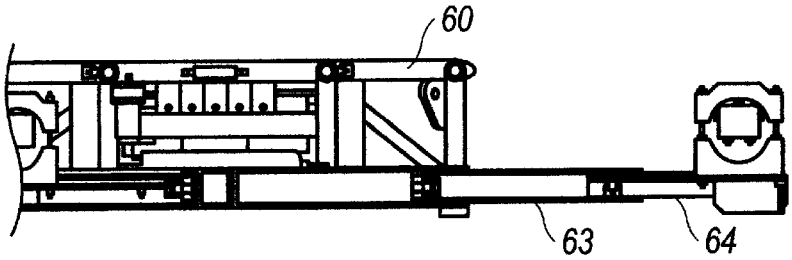
Figure 18D:
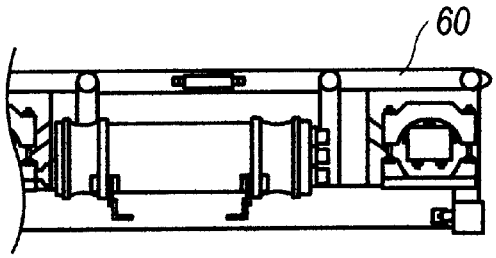
Figure 18E:
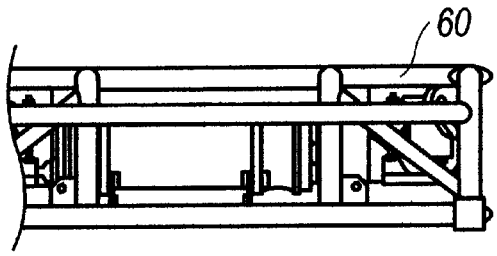
Figure 18F:
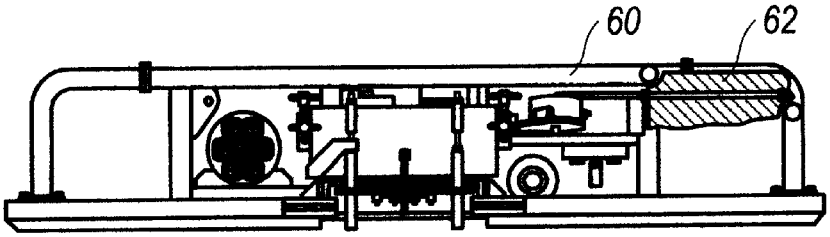

The skid valves should be configured as follows and as shown in FIG. 17.

| Closed Valves | Open Valves |
|---|---|
| 114 | 111 |
| 14 | 113 |
| 11 | 117 |
| 12 | 118 |
| 13 | 119 |
| 18 | 17 |
| 112 | 19 |
| 22 | |
| 120 | |
| 20 | |
| 26 | |

The above configuration will allow the piping between valve 120 and the sampling bottle piston 116 to be filled with nitrogen. The pressure in the pipework is shown on the bottle pressure gauge. As the piston 116 is free to move, the water/glycol mix at the back of the bottle will also be pressurised from the bottle piston 116 through to valve 114. Thus both of the points where the bottle is connected into the skid will be tested. The bottle piston seal need not be tested, as this will have been done onshore. Only a small volume of nitrogen will be required to test the piping. Thus the pressure in the piping will rise quickly when the nitrogen supply is opened.

Soapy water is applied around the bottle connection point adjacent to valve 20 to detect leaks. The connection at the rear of the bottle should be dried.

The nitrogen pressure is gradually increased to a pressure of 125 barg. The bottle piston 116 should not move a significant amount during the test. If the piston continues to move during pressurising then this indicates a leak from the piping at the back end of the bottle.

The nitrogen supply is closed by valve 118 and disconnected, and the system is left pressurised for 30 minutes. Assuming no leaks valve 118 is opened to vent off the nitrogen.

Once all sampling operations are complete the sampling skid can be disconnected from the ROV 200. The skid itself should not contain any fluids at pressure. The only fluids at pressure will be within the sample bottles.

The hydraulic supply lines to the sampling skid valves are vented to atmospheric pressure, disconnected and stored in the transportation case.

All electrical supply and control cables are disconnected between the ROV 200 and the skid, any hydraulic or electrical ports on the skid are capped to prevent debris ingress. All valves are closed and pressure caps are fitted on the outlets of valves 26, 12, 18, 112, 118. The flexible pipe from the safety relief valve on the slops tank 41 should be checked for security and left in place until the slops tank 41 is demobilised from the vessel.

Before storage the valves 46 and 47 should be closed and valve opened. The outlet ports from all valves should be left clear so that leaks past the valves can be detected. A final leak test is then carried out by filling the tank with nitrogen through the connection point at valve 45 to a test pressure of 2.5 barg for 10 minutes, after which the valve 45 is closed and the nitrogen supply is disconnected. The pressure and temperature are monitored over a period of 30 minutes, and a soapy solution is applied to all flange joints and valve body joints to check for leaks. If there is leakage it will most likely be past the valves or from the flanged connection on the vessel. The flanged connections may have to be re-assembled or the valves refurbished/replaced.

The nitrogen can be vented by opening valve 46. A slight positive pressure of 0.1 barg is preferably maintained within the vessel.

Modifications and improvements can be incorporated without departing from the scope of the invention.

What is claimed is:

1. A method for sampling a fluid produced from a wellbore, the method comprising:

providing a vehicle having a drive means for moving the vehicle, a collecting device for collecting a sample of fluid, and a storage facility for the collected sample of fluid, said collecting device and said storage facility being connected to said vehicle;

using the collecting device to collect a sample of the fluid from a subsea structure at a first location;

storing the sample in said storage facility of said vehicle; and carrying the sample to a second location which is different from said first location.

2. A method as claimed in claim 1, wherein the first location is a wellhead.

3. A method as claimed in claim 1, wherein the first location has a collection port which mates with the collecting device, and the method in includes the step of engaging the collecting device with the collection port at the first location, and transferring the fluid through the collection port and collecting device while they are engaged.

4. A method as claimed in claim 1, wherein said vehicle is remotely operated.

5. A method as claimed in claim 1 wherein said storage facility and said collecting device are housed on a frame attached to the vehicle.

6. A method as claimed in claim 1, wherein the collecting device comprises at least one sample container for containing the sample collected, and the method includes the further step of storing the sample collected in the sample container.

7. A method as claimed in claim 1, wherein the vehicle has a probe for connecting to the subsea structure at said first location and the method includes the step of connecting the vehicle to the subsea structure via the probe and collecting the sample through the probe.

8. A method as claimed in claim 1 including the step of discarding a portion of the fluid collected.

9. A method as claimed in claim 1 including the step of detaching the vehicle from the subsea structure at said first location, removing the sample when the vehicle has moved to the second position, and analyzing the sample at said second location.

10. A method as claimed in claim 1, wherein the collecting device has several separate sample containers for collecting samples, and the method includes the step of collecting a further sample from at least one other subsea structure before the vehicle moves to the second location for analysis of the samples.

11. A method as claimed in claim 1, wherein said device can be controlled from a position remote from the first location, and the method includes the step of controlling the device remotely.

12. A sampling device for collecting samples of fluid produced from a subsea wellbore, the sampling device having a drive means for moving the sampling device, a collecting device for collecting a sample of fluid and a storage container for holding the collected fluid, wherein the drive means comprises a remotely operated vehicle.

13. A sampling device as claimed in claim 12, wherein the wellbore has a wellhead and the collecting device comprises a probe for engaging a port on the wellhead.

14. A sampling device as claimed in claim 12, wherein the storage container comprises at least one bottle having a piston movable within the bottle.

15. A sampling device as claimed in claim 12, having means to indicate characteristics of the sample collected, the characteristics being selected from the group consisting of pressure, volume and temperature.

16. A sampling device as claimed in claim 15, wherein the indicator means is configured to indicate the selected characteristics on a continuous basis.

17. A sampling device as claimed in claim 12, wherein the device is adapted to collect the fluid sample from a subsea fluid-carrying structure selected from the group consisting of wellheads, manifolds, pipelines, wellbores, casings, tubulars, storage tanks and gravity base structure.

18. A sampling device as claimed in claim 12, wherein the storage container has a fail safe valve to seal the container in the event of a power failure.

19. A method for sampling a fluid produced from a plurality of wellbores, comprising the steps of:

using an underwater vehicle to receive a plurality of fluid samples from respective ones of said plurality of wellbores and to store said plurality of fluid samples in a plurality of respective containers;

transporting said plurality of containers to an operating station for testing.

20. The method of claim 19, wherein said underwater vehicle receives and discards a first sample from sampled wellbores and then receives a second sample.

21. The method of claim 19, wherein said underwater vehicle inserts a male probe into a female receiver at a wellbore in order to receive a fluid sample.

22. The method of claim 19, wherein said underwater vehicle is remotely controlled to perform said using and said transporting steps.

23. A system for sampling wellbore-produced fluids, said system comprising:

a plurality of wellbores located underwater;

an operating station, which is at a location separate from said plurality of wellbores, said operating station having a capability to receive and test samples of fluid;

a collection vehicle which is configured to collect separate samples of fluid from one of said plurality of wellbores and transport said separate samples to said operating station.

24. The system of claim 23, wherein said collection vehicle comprises a remotely operated vehicle.

25. The system of claim 23, wherein the output of said plurality of wellbores all feed into a single manifold.

26. The system of claim 23, wherein said operating station is onshore.

27. The system of claim 23, wherein said collection vehicle is configured to discard, to a waste container, a first sample from a sampled wellbore and to store a second sample from a sampled wellbore.

* * * * *

UNITED STATES PATENT AND TRADEMARK OFFICE

CERTIFICATE OF CORRECTION

PATENT NO. : 6,435,279 C1
APPLICATION NO. : 95/001161
DATED : September 11, 2012
INVENTOR(S) : David Charles Howe and Kevin Fraser Robb It is certified that error appears in the above-identified patent and that said Letters Patent is hereby corrected as shown below:

In claim 28, column 2, line 39, delete “side” and insert --said--.

Signed and Sealed this
Sixth Day of November, 2012

David J. Kappos

David J. Kappos
*Director of the United States Patent and Trademark Office*

US006435279C1

(12) INTER PARTES REEXAMINATION CERTIFICATE (0448th)

United States Patent

Howe et al.

(10) Number: US 6,435,279 C1

(45) Certificate Issued: Sep. 11, 2012

(54) METHOD AND APPARATUS FOR SAMPLING FLUIDS FROM A WELLBORE

(76) Inventors: David Charles Howe, Aberdeen (GB); Kevin Fraser Robb, Stonehaven (GB); Michael Fowkes, Aberdeenshire (GB)

Reexamination Request:
No. 95/001,161, Apr. 9, 2009

Reexamination Certificate for:

| | |
|---|---|
| Patent No.: | **6,435,279** |
| Issued: | **Aug. 20, 2002** |
| Appl. No.: | **09/546,256** |
| Filed: | **Apr. 10, 2000** |

(51) Int. Cl.
*E21B 7/12* (2006.01)

(52) U.S. Cl. ..... 166/336; 166/351

(58) Field of Classification Search ..... 166/336, 166/334, 357, 250.1, 264; 405/169, 190, 405/344

See application file for complete search history.

(56) References Cited

To view the complete listing of prior art documents cited during the proceeding for Reexamination Control Number 95/001,161, please refer to the USPTO's public Patent Application Information Retrieval (PAIR) system under the Display References tab.

*Primary Examiner*—Aaron J. Lewis

(57) ABSTRACT

A method and apparatus for sampling fluids from an undersea wellbore comprising a self-propelled underwater vehicle and a collection and storage device; so that samples may be recovered directly from the wellbore and subsequently analyzed to determine the characteristics of the oil produced from separate wells.

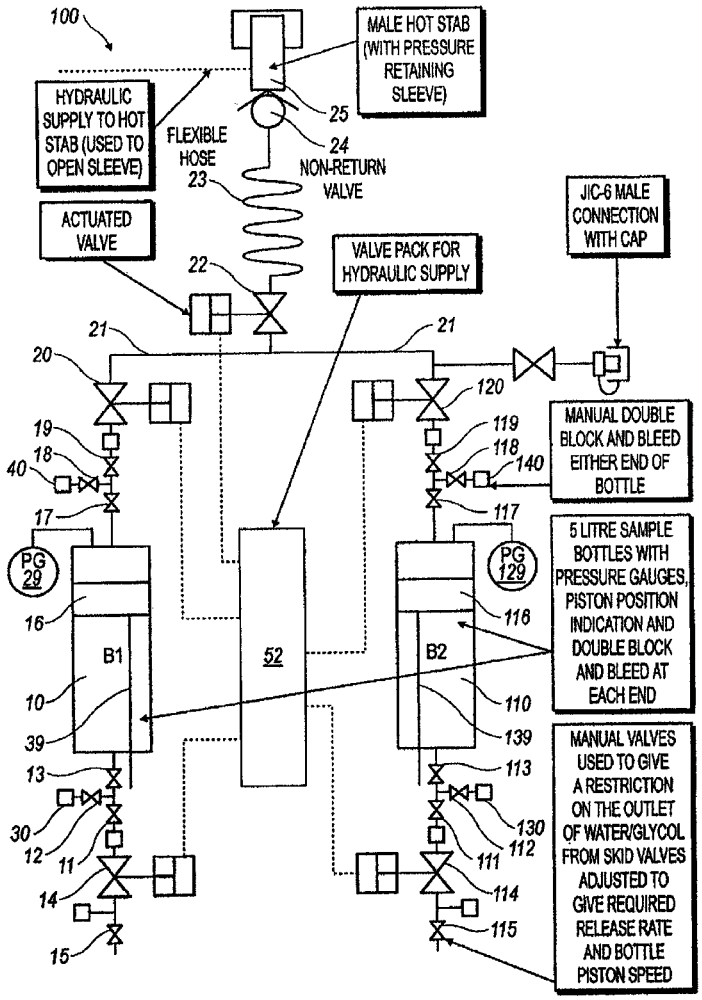

Sampling Equipment

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 10, 18, 20 and 23-27 are cancelled.

Claims 1, 2, 12, 13, 19 and 21 are determined to be patentable as amended.

Claims 3-9, 11, 14-17 and 22, dependent on an amended claim, are determined to be patentable.

New claims 28-49 are added and determined to be patentable.

1. A method for sampling a fluid produced from a wellbore, the method comprising:

providing a vehicle having a drive means for moving the vehicle, a collecting device for collecting a sample of fluid, and a storage facility for the collected sample of fluid, said collecting device and said storage facility being connected to said vehicle;

using the collecting device to collect a sample of the fluid from a subsea structure at a first location;

storing the sample in said storage facility of said vehicle; and carrying the sample to a second location which is different from said first location, *wherein the collecting device has several separate sample containers for collecting samples, and the method includes the step of collecting a further sample from at least one other subsea structure before the vehicle moves to the second location for analysis of the samples*.

2. [A method as claimed in claim 1] *A method for sampling a fluid produced from a wellbore, the method comprising:*

*providing a vehicle having—a drive means for moving the vehicle, a collecting device for collecting a sample of fluid, and a storage facility for the collected sample of fluid, said collecting device and said storage facility being connected to said vehicle;*

*using the collecting device to collect a sample of the fluid from a subsea structure at a first location;*

*storing the sample in said storage facility of said vehicle; and*

*carrying the sample to a second location which is different from said first location*, wherein the first location is a wellhead.

12. A sampling device for collecting samples of fluid produced from a subsea wellbore, the sampling device having a drive means for moving the sampling device, a collecting device for collecting a sample of fluid and a storage container for holding the collected fluid, wherein the drive means comprises a remotely operated vehicle, *wherein the storage container has a fail safe valve to seal the container in the event of a power failure*.

13. [A sampling device as claimed in claim 12] *A sampling device for collecting samples of fluid produced from a subsea wellbore, the sampling device having a drive means for moving the sampling device, a collecting device for collecting a sample of fluid and a storage container for holding the collected fluid, wherein the drive means comprises a remotely operated vehicle*, wherein the wellbore has a wellhead and the collecting device comprises a probe for engaging a port on the wellhead.

19. A method for sampling a fluid produced from a plurality of wellbores, comprising the steps of:

using an underwater vehicle to receive a plurality of fluid samples from respective ones of said plurality of wellbores and to store said plurality of fluid samples in a plurality of respective containers;

transporting said plurality of containers to an operating station for testing, *wherein said underwater vehicle receives and discards a first sample from sampled wellbores and then receives a second sample*.

21. [The method of claim 19] *A method for sampling a fluid produced from a plurality of wellbores, comprising the steps of:*

*using an underwater vehicle to receive a plurality of fluid samples from respective ones of said plurality of wellbores and to store said plurality of fluid samples in a plurality of respective containers;*

*transporting said plurality of containers to an operating station for testing*, wherein said underwater vehicle inserts a male probe into a female receiver at a wellbore in order to receive a fluid sample.

*28. A method for sampling a fluid produced from a wellbore, the method comprising:*

*using a collecting device, which is mounted to a movable undersea vehicle, to open at least one valve and then collect a sample of the fluid from a subsea structure at a first location;*

*wherein said collecting operation is performed while side vehicle is held to said subsea structure by a fail-safe mechanism, and wherein said vehicle carries enough stored power to allow said fail-safe mechanism to close said valve even in the case of sudden loss of power;*

*storing the sample in said storage facility of said vehicle; and*

*carrying the sample to a second location which is different from said first location.*

*29. The method of claim 28, wherein the collecting device includes a hot stab with an anti-leakage valve.*

*30. The method of claim 28, wherein said storage facility include sample bottles which are piston-driven.*

*31. The method of claim 30, wherein said storage facility includes one bottle for slop.*

*32. The method of claim 28, wherein a first flow through said valve is routed directly to a slop container.*

*33. The method of claim 32, wherein a second flow through said valve is routed directly to a sample container.*

*34. The method of claim 28, wherein after a sample is placed into a storage container, said storage container is then held closed without pressure change, while other parts of said device can equalize pressures with ambient.*

*35. The device of claim 28, wherein after a sample is placed into the storage container, said storage container is then held closed without pressure change, while other parts of said device can equalize pressures with ambient.*

*36. A method for sampling a fluid produced from a plurality of wellbores, comprising the steps of:*

*using an underwater vehicle to mate to subsea structures, open respective valves which are mounted on said structures, and receive a plurality of fluid samples through said valves from respective ones of said plurality of wellbores, and to store said plurality of fluid samples in a plurality of respective containers;*

*said underwater vehicle including a fail-safe mechanism which includes stored power sufficient to close anyone of said valves which may be open, at a structure which said vehicle is docked to, in case of sudden power failure; and*

*transporting said plurality of containers to an operating station for testing.*

*37. The method of claim 36, further comprising the step of:*

*sampling fluid with a collecting device comprising a hot stab with an anti-leakage valve.*

*38. The method of claim 36, wherein said containers comprise sample bottles which are piston-driven.*

*39. The method of claim 38, wherein said containers comprise at least one bottle for slop.*

*40. The method of claim 36, wherein a first flow through said valves is routed directly to a slop container.*

*41. The method of claim 36, wherein a second flow through said valves is routed directly to a sample container.*

*42. The method of claim 36, wherein after a sample is placed into a container, said container is then held closed without pressure change, while other parts of said device can equalize pressures with ambient.*

*43. A method for sampling a fluid produced from a plurality of wellbores, comprising the steps of:*

*using an underwater vehicle to mate to subsea structures, open respective valves which are mounted on said structures, and receive a plurality of fluid samples through said valves from respective ones of said plurality of wellbores, and to store said plurality of fluid samples in a plurality of respective containers;*

*said underwater vehicle including a fail-safe mechanism which includes stored power sufficient to close anyone of said valves which may be open, at a structure which said vehicle is docked to, in case of sudden power failure if power suddenly fails on said vehicle; and*

*transporting said plurality of containers to an operating station for testing.*

*44. The method of claim 43, further comprising the step of: receiving fluid through a collecting device comprising a hot stab with an anti-leakage valve.*

*45. The method of claim 44, wherein said containers comprise sample bottles which are piston-driven.*

*46. The method of claim 44, wherein said containers comprises at least one bottle for slop.*

*47. The method of claim 44, wherein a first flow through said valve is routed directly to a slop container.*

*48. The method of claim 47, wherein a second flow through said valve is routed directly to a sample container.*

*49. The method of claim 47, wherein after a sample is placed into the container, said container is then held closed without pressure change, while other parts of said device can equalize pressures with ambient.*

* * * * *